US008299923B2

(12) United States Patent
Hammoud

(10) Patent No.: US 8,299,923 B2
(45) Date of Patent: Oct. 30, 2012

(54) ELECTRONIC MAIL BOX SYSTEM

(76) Inventor: Hassan Hammoud, Windsor (CA)

( * ) Notice: Subject to any disclaimer, the term of this patent is extended or adjusted under 35 U.S.C. 154(b) by 336 days.

(21) Appl. No.: 12/780,235

(22) Filed: May 14, 2010

(65) Prior Publication Data

US 2010/0253518 A1 Oct. 7, 2010

Related U.S. Application Data

(63) Continuation-in-part of application No. 12/707,948, filed on Feb. 18, 2010.

(60) Provisional application No. 61/167,102, filed on Apr. 6, 2009.

(51) Int. Cl.
*G08B 21/00* (2006.01)

(52) U.S. Cl. ..... 340/569

(58) Field of Classification Search ..... 340/569, 340/568.1, 539.14, 545.6; 455/412.2
See application file for complete search history.

(56) References Cited

U.S. PATENT DOCUMENTS

| | | | | |
|---|---|---|---|---|
| 3,611,333 | A * | 10/1971 | Conigliaro | 340/539.14 |
| 4,101,877 | A | 7/1978 | Rush | |
| 4,520,350 | A | 5/1985 | Huang | |
| 5,023,595 | A * | 6/1991 | Bennett | 340/569 |
| 5,774,053 | A * | 6/1998 | Porter | 340/568.1 |
| 5,917,411 | A | 6/1999 | Baggarly | |
| 6,107,934 | A | 8/2000 | Andreou et al. | |
| 6,694,580 | B1 | 2/2004 | Hatzold | |
| 6,788,203 | B1 * | 9/2004 | Roxbury et al. | 340/545.6 |
| 6,995,671 | B2 | 2/2006 | Dutta et al. | |
| D518,399 | S | 4/2006 | Breslow | |
| 7,486,948 | B1 * | 2/2009 | Vergon | 455/412.2 |
| 7,786,862 | B1 * | 8/2010 | Campbell | 340/569 |
| 2005/0253715 | A1 * | 11/2005 | Awobue | 340/569 |

FOREIGN PATENT DOCUMENTS

| | | |
|---|---|---|
| WO | 9741542 | 11/1997 |
| WO | 9743935 | 11/1997 |

* cited by examiner

*Primary Examiner* — Jennifer Mehmood
*Assistant Examiner* — Kaleria Knox
(74) *Attorney, Agent, or Firm* — Kyle R. Satterthwaite; Ryan W. Dupuis; Ade & Company Inc.

(57) ABSTRACT

An electronic mailbox system features: a mailbox housing with an inner cavity and slot for holding mail, a lid, an electrically-operable lock system for the lid, a mail sensor for detecting the mail being inserted into the slot, a first transmitter, a first receiver and a mailbox microprocessor; and a control box with a second transmitter, a second receiver, a control box indicator light, an unlock button, a reset button, and a control box microprocessor. When the mail sensor detects mail delivery the control box indicator light becomes illuminated. When the unlock button is pushed the lock system unlocks. When the reset button is pressed the indicator light is deactivated. An alarm system may be activated upon receipt of mail and/or if a tamper sensor detects tampering.

17 Claims, 29 Drawing Sheets

FIG. 12
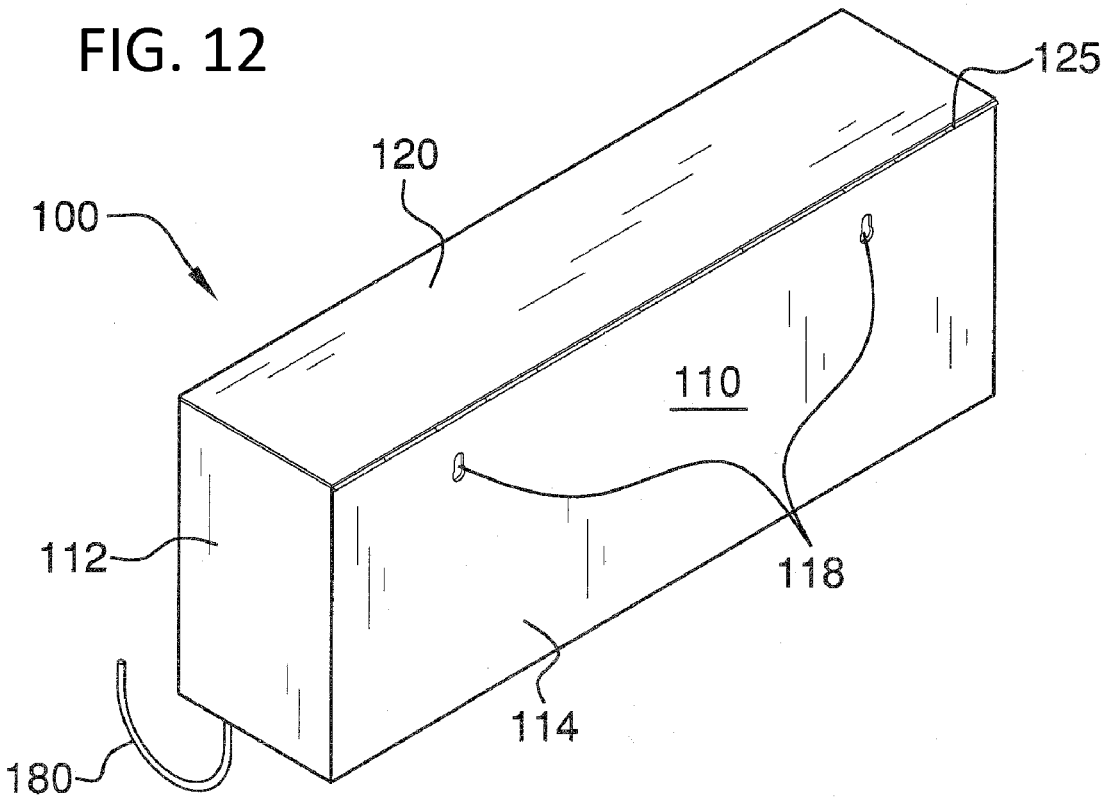
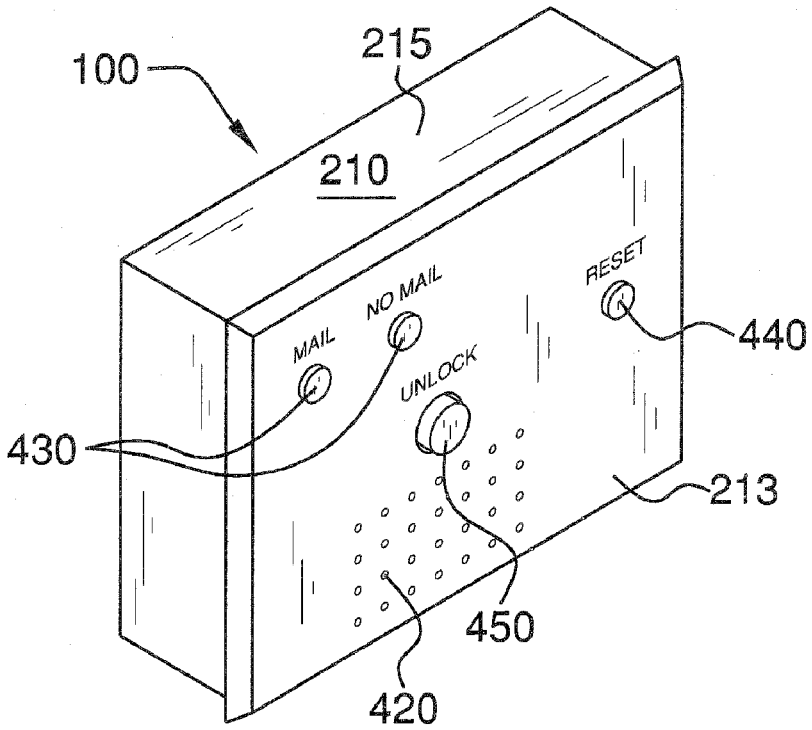
FIG. 13

ELECTRONIC MAIL BOX SYSTEM

CROSS REFERENCE

This application claims priority to U.S. Provisional Application Ser. No. 61/167,102 filed Apr. 6, 2009 and U.S. patent application Ser. No. 12/707,948 filed Feb. 18, 2010, the specifications of which is incorporated herein by reference in its entirety.

BACKGROUND

The present invention is directed to a mailbox. More particularly, the present invention is directed to an electronic mailbox having an electronic means of securing mail and a transmit-receiver system for alerting a user when mail has arrived.

Although it is illegal for individuals to take or tamper with another individual's mail, it is a very common occurrence. The present invention features an electronic mailbox system for providing a secure environment for receiving mail. The electronic mailbox system comprises a mailbox housing having an electronic lock that can only be opened by the user. The system can detect when mail arrives and alert the user (via a control box) that mail is in the mailbox.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features electronic mailbox systems. In some embodiments, the system comprises a mailbox housing comprising: (i) an inner cavity for holding a piece of mail; (ii) a lid moveable between an open position and a closed position respectively allowing and preventing access to the inner cavity; (iii) an electrically-operable lock system operatively connected to the lid, the lock system can move between a locked position which secures the lid in the closed position and an unlocked position which permits the lid to be moved to the open position; (iv) a slot disposed in the mailbox housing for accommodating the piece of mail; (v) a mail sensor (such as an optical sensor) for detecting the piece of mail being inserted into the slot; (vi) a first transmitter and a first receiver; and (vii) a mailbox microprocessor operatively connected to each of the mail sensor, the lock system, the first transmitter, and the first receiver. The system may further comprise a tamper sensor for detecting tampering of the mailbox housing, the tamper sensor being operatively connected to the mailbox microprocessor.

The system further comprises a control box comprising (i) a second transmitter and a second receiver, wherein the second receiver is configured to receive signals from the first transmitter and the first receiver is configured to receive signals from the second transmitter; (ii) a control box indicator light; (iii) an unlock button; (iv) a reset button; and (v) a control box microprocessor operatively connected to each the second transmitter, the second receiver, the control box indicator light, the unlock button, and the reset button. In some embodiments, the system further comprises an alarm system operatively connected to the control box microprocessor.

In some embodiments, the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box. In some embodiments, the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated.

In some embodiments, the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing. In some embodiments, the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position.

In some embodiments, the mailbox microprocessor is configured to receive a second sensor input signal from the tamper sensor when the tamper sensor detects tampering, wherein upon receipt of the second sensor input signal the mailbox microprocessor generates a fourth transmitter output command to the first transmitter to cause the first transmitter to send a fourth transmitter signal to the second receiver. In some embodiments, upon receipt of the fourth transmitter signal, the second receiver sends a fourth receiver input signal to the control box microprocessor whereupon the control box microprocessor generates a second alarm output command to the alarm system to activate the alarm system.

In some embodiments, the control box microprocessor is configured to receive a first reset input signal from the reset button when the reset button is pressed whereupon the control box microprocessor generates (i) a first reset output command to the control box indicator light to cause the control box indicator light to become deactivated; or (2) a third reset output command to the alarm system to deactivate the alarm, whether or not such a first reset output command is also generated.

In some embodiments, the mailbox housing further comprises a mailbox indicator light operatively connected to the mailbox microprocessor, wherein when the mailbox microprocessor receives the first sensor input signal from the mail sensor the mailbox microprocessor generates a first light output command to the mailbox indicator light to activate the mailbox indicator light. In some embodiments, when the control box microprocessor receives the first reset input signal from the reset button the control box microprocessor generates a second reset output command to the second transmitter to cause the second transmitter to send a third transmitter signal to the first receiver in the mailbox housing; wherein the first receiver is configured to send a second light input signal to the mailbox microprocessor when the first receiver receives the third transmitter signal from the second transmitter, whereupon the mailbox microprocessor generates a second light output command to the mailbox indicator light to deactivate the mailbox indicator light.

In some embodiments, the system further comprises a newspaper holder disposed on the mailbox housing. In some embodiments, the mailbox housing further comprises an awning positioned over the slot to help prevent moisture from entering into the slot. In some embodiments, the mailbox housing further comprises an inner door attached to an inside surface of a front surface of the mailbox housing such that it covers the slot, the inner door is moveable between an open position and a closed position respectively allowing and preventing access to the inner cavity of the mailbox housing, the inner door is biased in the closed position caused by a spring. In some embodiments, the lock system comprises a good lock light for indicating the lock system is in the locked position. In some embodiments, the unlock button comprises a keypad system. In some embodiments, the lock system comprises an emergency unlocking mechanism.

In some embodiments, when the control box microprocessor receives the second receiver input signal the control box microprocessor generates a first alarm output command to the alarm system to activate the alarm system. In some embodiments, the alarm system is configured to emit a first sound when the alarm system receives the first alarm output command and the alarm system is configured to emit a second sound when the alarm system receives the second alarm output command.

In some embodiments, the lock system comprises an auto-lock mechanism, the auto-lock mechanism function to causing the lock system to become locked after a certain length of time after the lock system has been unlocked. In some embodiments, if the lock system is not relocked after the certain length of time the alarm system is activated.

BRIEF DESCRIPTION OF THE DRAWINGS

Specific embodiments of the invention will now be described, purely by way of example, with reference to the drawings, in which:

FIG. 12 is a rear perspective view of the mailbox housing of FIG. 11.

FIG. 13 is an alternative embodiment of a control box of the system of the present invention.

DESCRIPTION OF THE INVENTION

Referring now to FIG. 1-23, the present invention features an electronic mailbox system 100 for providing a secure environment for receiving mail.

Figure 1:
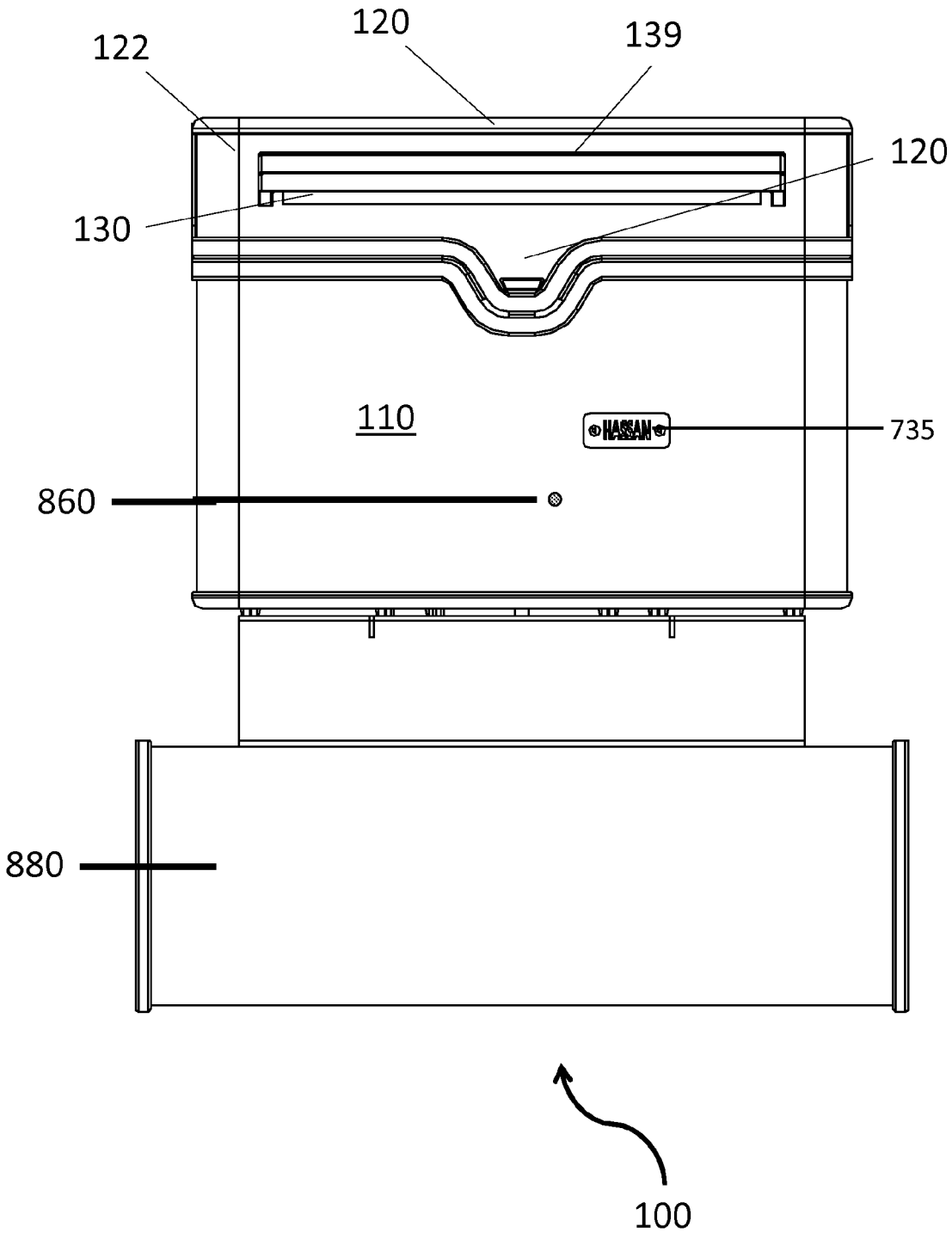
FIG. 1 is a front view of a mailbox housing of the system of the present invention.

As shown in FIG. 1, the electronic mailbox system 100 comprises a mailbox housing 110 having a first side, a second side, a front surface, a back surface, a bottom surface, and an inner cavity for holding mail. A lid 120 (e.g. "output door") is pivotally attached to the mailbox housing 110 (e.g., the back surface, a top surface). The lid 120 (e.g. "output door") can move between an open position and a closed position respectively allowing and preventing access to the inner cavity of the mailbox housing 110.

In some embodiments, a newspaper holder 880 is disposed on the mailbox housing 110, for example on the bottom surface (or other portion) of the mailbox housing 110. A newspaper can be attached or inserted into to the newspaper holder 880.

Disposed in the front surface of the mailbox housing 110 is a slot 130. The slot 130 allows mail to be inserted into the mailbox housing 110. In some embodiments, the front surface of the mailbox housing 110 comprises an awning 139 positioned over the slot 130 (covering the slot 130) to help prevent moisture (e.g., rain, snow, etc.) from entering into the slot 130.

In some embodiments, an inner door covers the slot 130 in the front surface of the mailbox housing 110. The inner door may be attached to the inside surface of the front surface of the mailbox housing 110 such that it covers the slot 130. The inner door is moveable between an open position and a closed position, and the inner door is biased in the closed position caused by a spring. The inner door can help to prevent dirt, rain, or snow from leaking into the mailbox housing 110.

Figure 2:
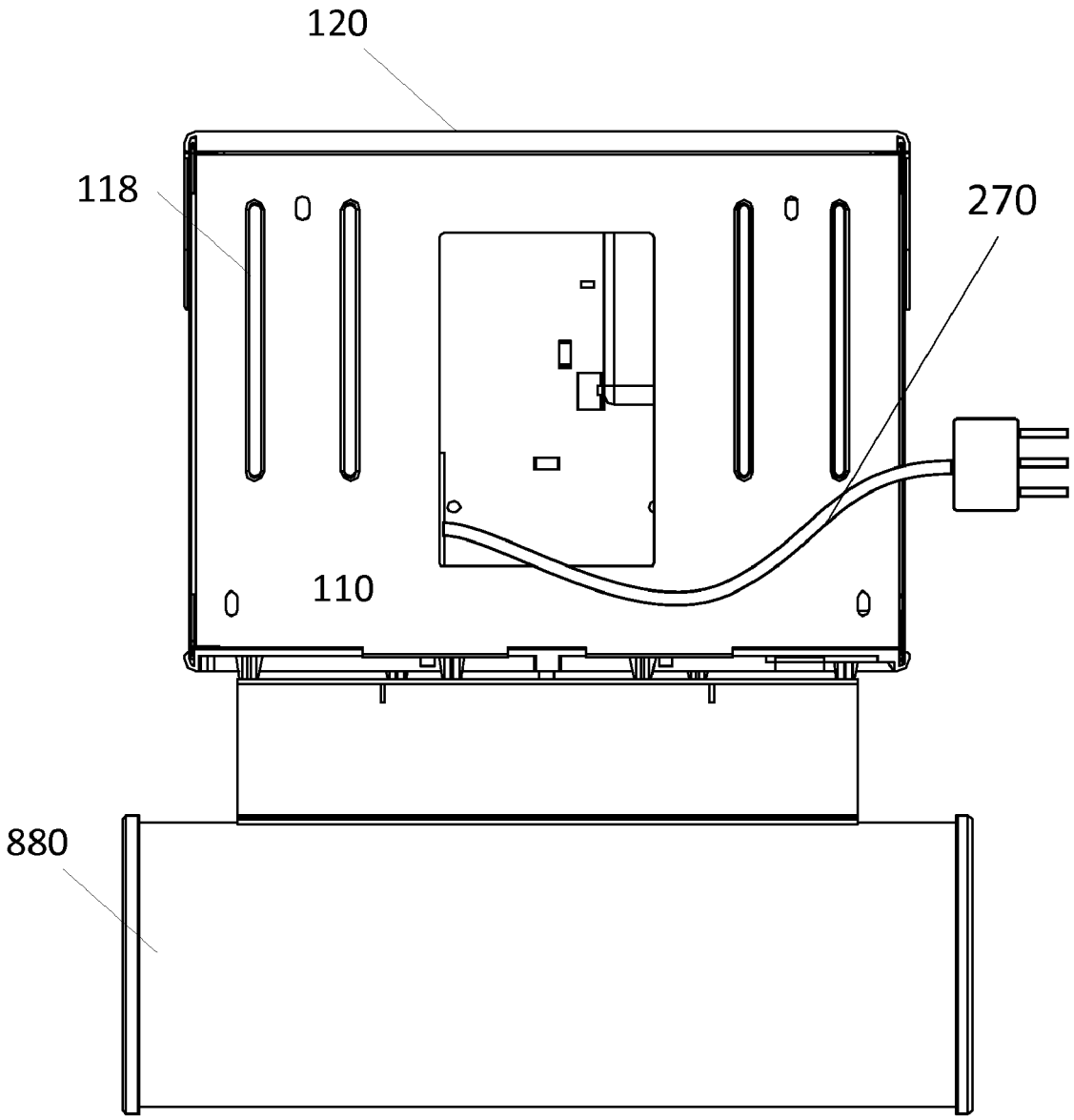
FIG. 2 is a rear view of the mailbox housing of FIG. 1.

Referring now to FIG. 2, one or more mounting holes 118 (or mounting slots) are disposed on the back surface of the mailbox housing 110. The mounting holes 118 are for allowing a user to mount the mailbox housing 110 on a wall or similar surface.

Figure 3:
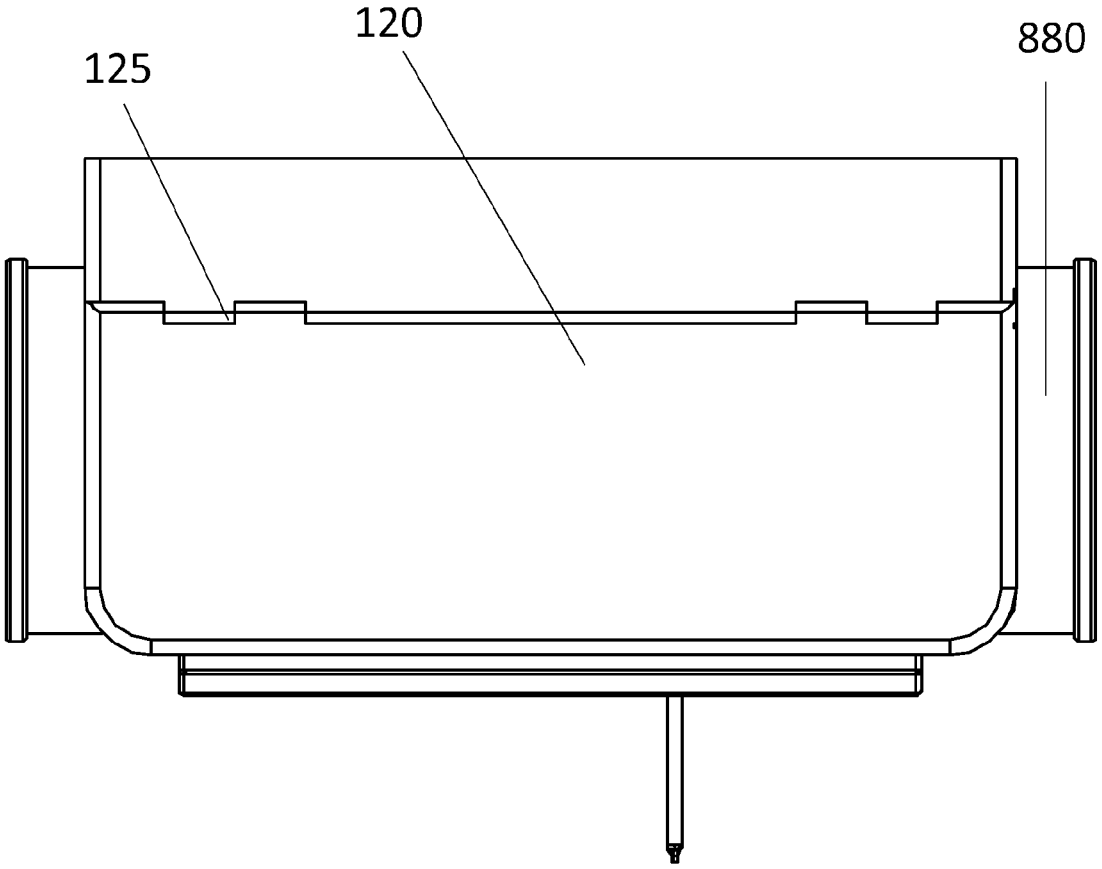
FIG. 3 is a top view of the mailbox housing of FIG. 1.
Figure 4:
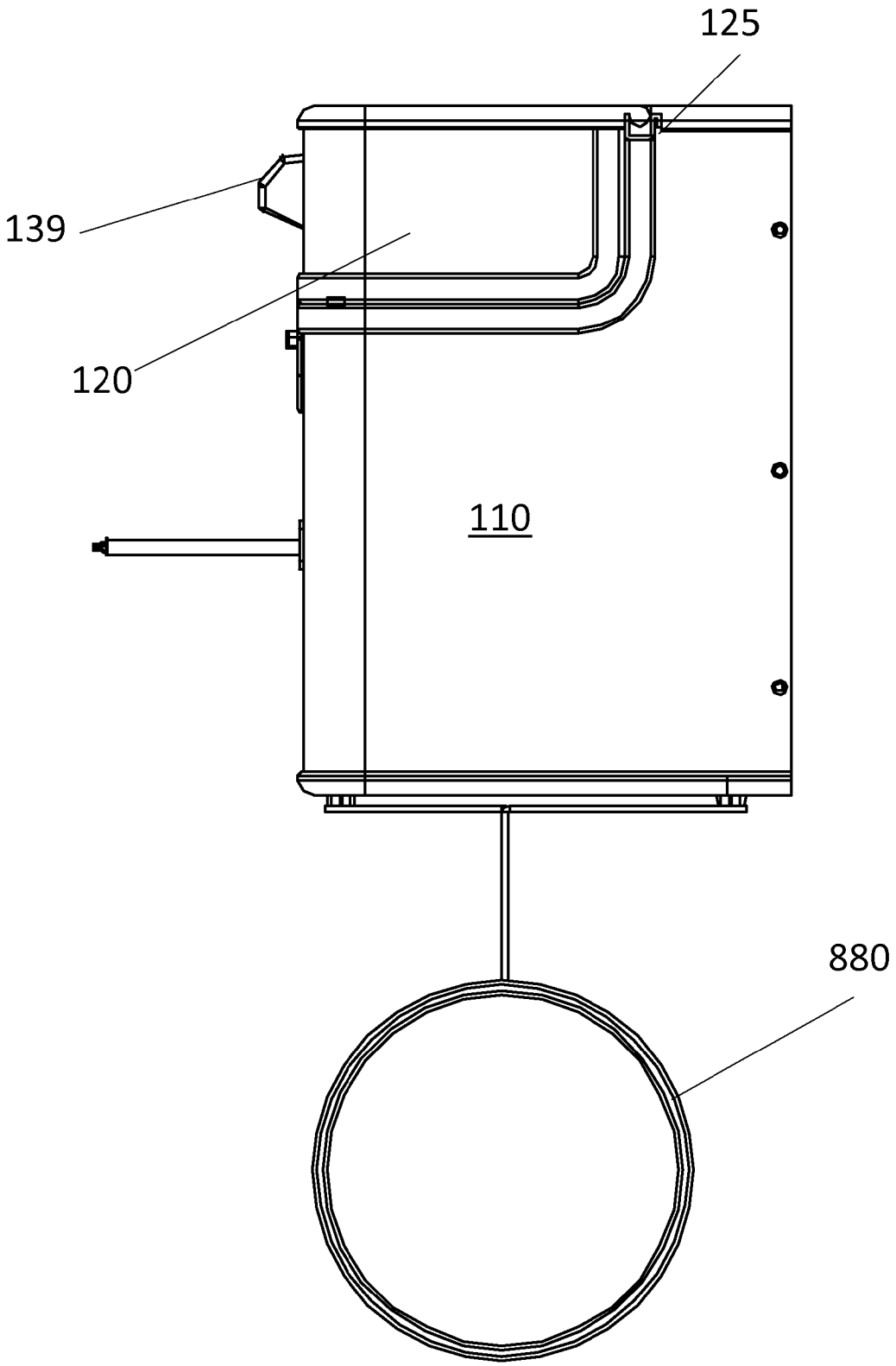
FIG. 4 is a side view of the mailbox housing of FIG. 1.
Figure 4A:
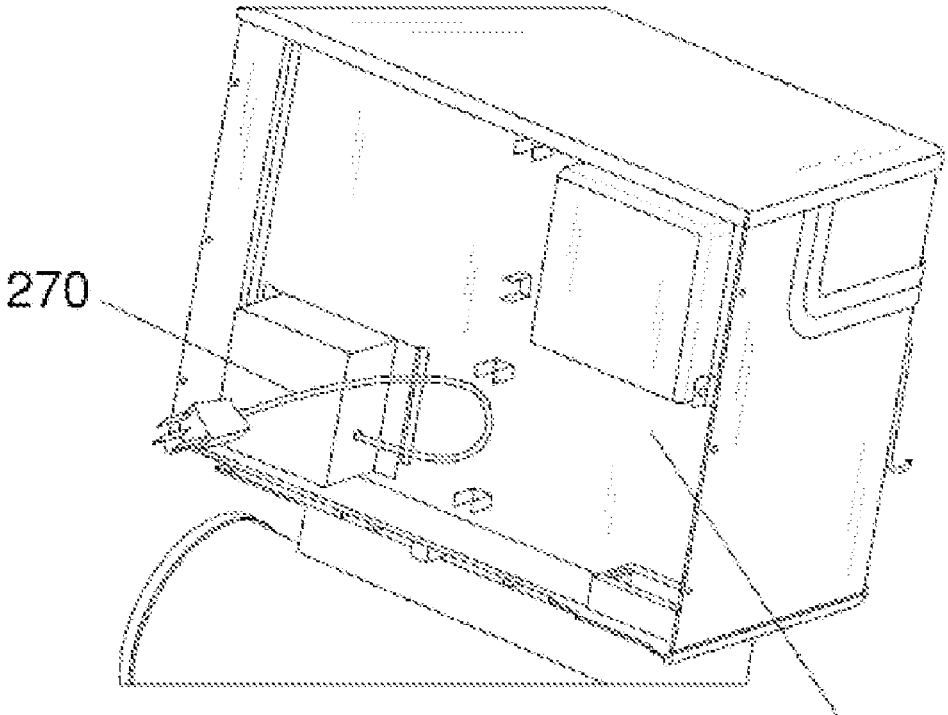
FIGS. 4A & 4B are both rear views of the mailbox housing comprising a power cord.
Figure 4B:
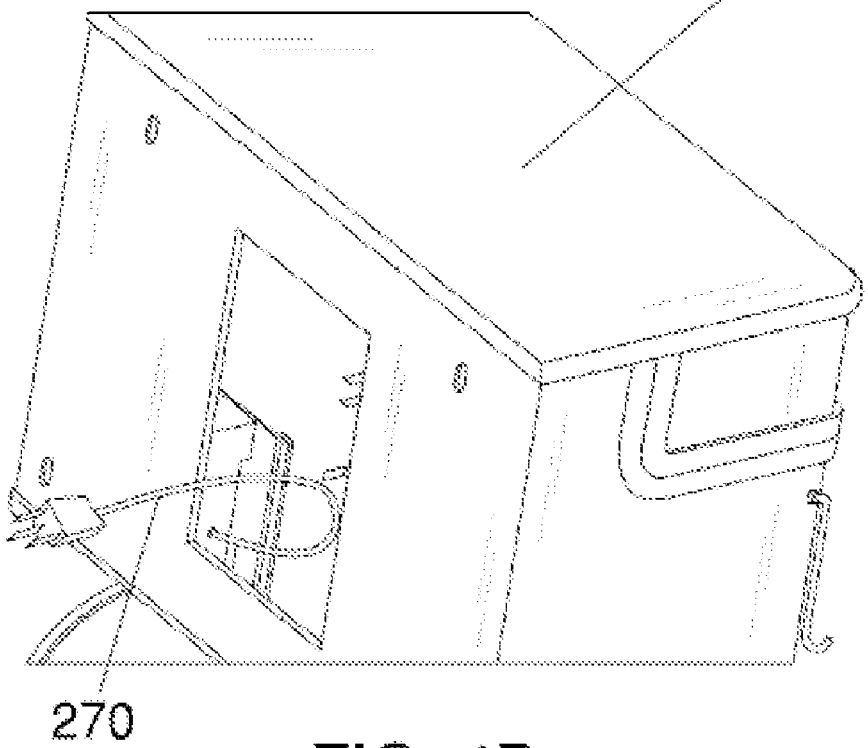

As shown in FIG. 3 and FIG. 4, the lid 120 (e.g. "output door") may be pivotally attached to a top surface of the housing 110 (e.g., via a hinge 125).

The lid 120 (e.g. "output door") can be locked in the closed position via a lock system. The lock system may be an electronic or electromagnetic lock, and such electronic and electromagnetic locks are well known to one of ordinary skill in the art. The lock system is operatively connected to a power source. The lock system can move between an unlocked position and a locked position respectively allowing and preventing access to the inner cavity of the mailbox housing 110. In some embodiments, the lock system is disposed inside the mailbox housing (e.g., on the front surface of the housing) and the lock system is operatively connected to the lid 120 (e.g. "output door").

In some embodiments, a good lock indicator light 860 (e.g., "GOOD LOCK LED") is disposed on the mailbox housing 110 (e.g., the front surface) and operatively connected to the lock system. When the lid 120 is locked correctly, the good lock indicator light 860 is activated (e.g., LED stays on GREEN). If not, the good lock indicator light is not turned on. This helps the user to ensure to the lid 120 is locked appropriately after the mail is retrieved.

A mailbox microprocessor is disposed in the mailbox housing 110. The mailbox microprocessor is operatively connected to an optical sensor. Optical sensors are well known to one of ordinary skill in the aft. The optical sensor is for detecting when a piece of mail is inserted into the mailbox housing 110 via the slot 130. The mailbox microprocessor is also operatively connected to a first transmitter, a first receiver, and the lock system. The mailbox microprocessor may be operatively connected to the various components (e.g., lock system, optical sensor, etc.) via one or more circuit boards (e.g., a printed circuit board, see FIG. 5, FIG. 6)

The mailbox microprocessor is configured to receive a first sensor input signal from the optical sensor when it detects mail has been placed in the mailbox housing 110. Upon receipt of the first sensor input signal the mailbox microprocessor is configured to generate a first transmitter output command to the first transmitter. Upon receipt of the first transmitter output command, the first transmitter is configured to transmit a first transmitter signal to a second receiver in a control box 210 (see FIG. 17A).

In some embodiments, the mailbox microprocessor is operatively connected to a mailbox indicator light disposed on the housing 110 (see FIG. 1). In some embodiments, when the mailbox microprocessor receives the first sensor input signal the mailbox microprocessor generates a first light output command to the mailbox indicator light to activate the mailbox indicator light (see FIG. 17C).

Figure 5:
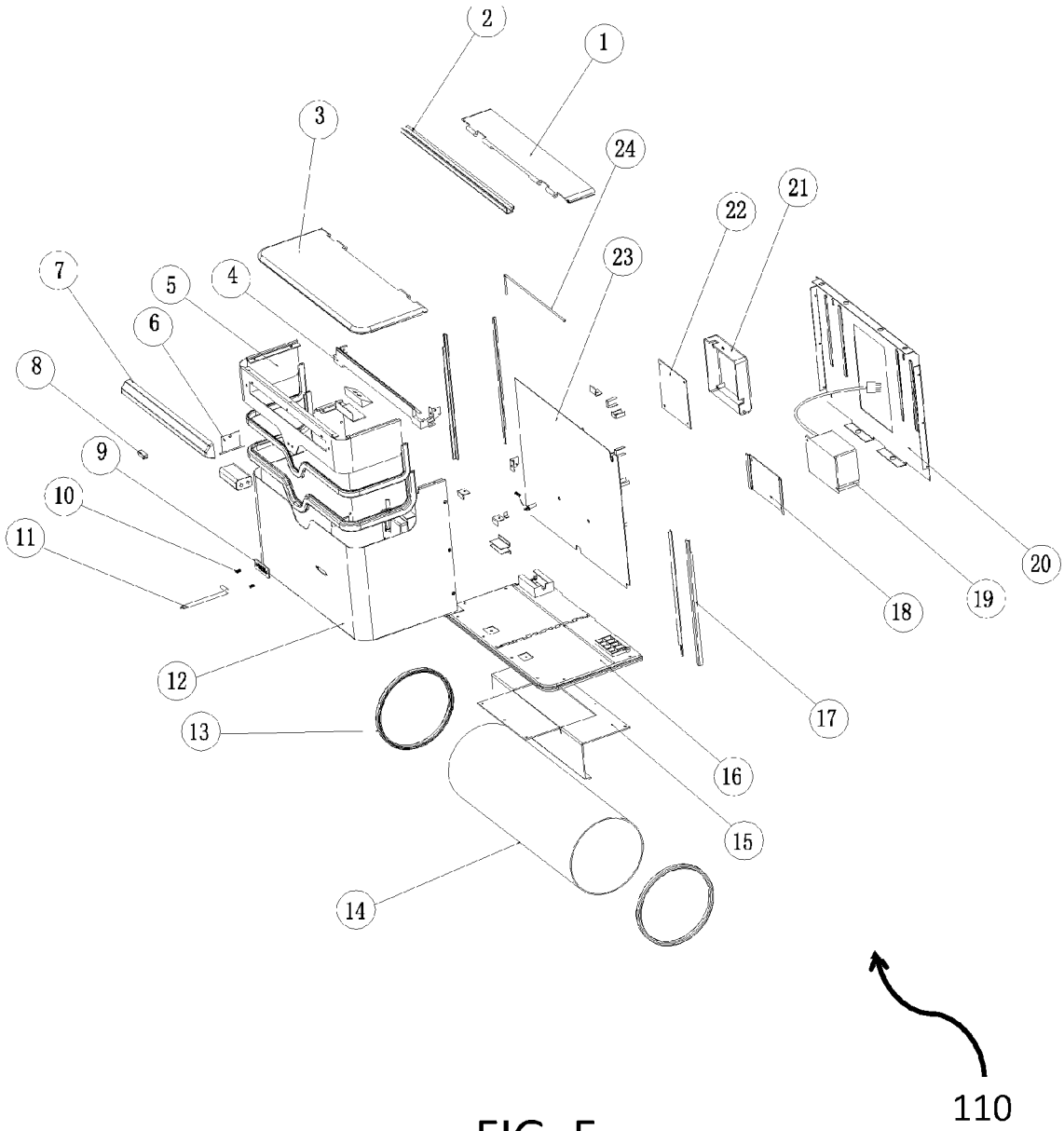
FIG. 5 is a front exploded view of the mailbox housing of FIG. 1.
Figure 6:
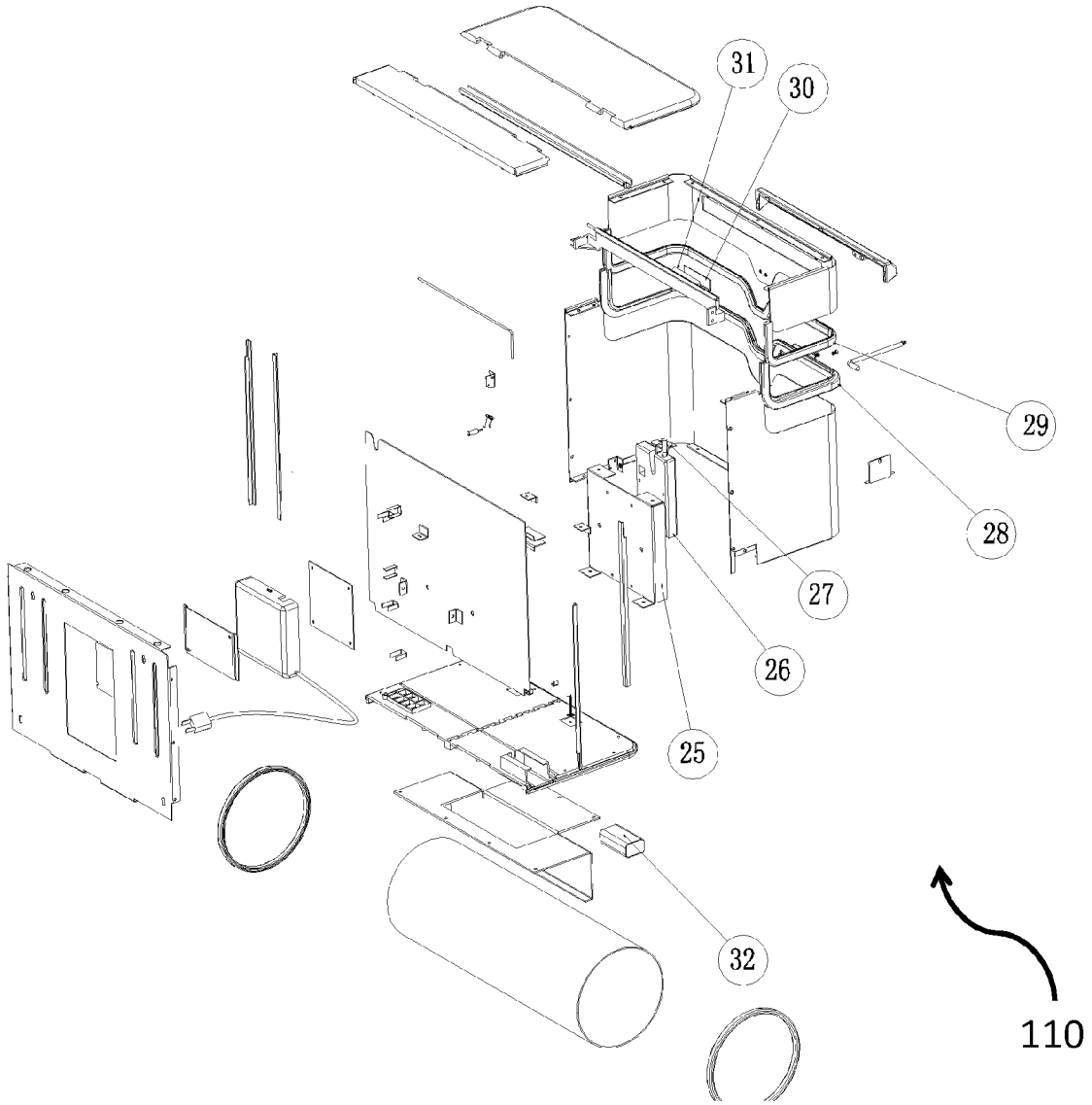
FIG. 6 is a rear exploded view of the mailbox housing of FIG. 1.

FIG. 5 and FIG. 6 are exploded views of an embodiment of the system 100 of the present invention. The mailbox housing 110 shown comprises a top surface 1, a water proof piece 2, a lid 3, an inner door 4, a top metal plate 5 (portion of the front surface and sides of the housing), a battery door 6, an awning 7, a holder 8, a nameplate 9 for attaching to the mailbox housing, a screw 10 for the nameplate 9, a tool key 11, a bottom metal plate 12 (portion of the front surface and sides of the housing), a plastic ring 13 for the newspaper holder 14, a newspaper holder 14, a newspaper holder bracket 15 (for attaching the newspaper holder 14 to the housing), a bottom surface 16, a baffle side plate 17, a support AC board 18, an adapter 19 to which a power cord (e.g., AC power cord is attached), a back surface 20, a printed circuit board (PCB) cover 21, a printed circuit board (PCB) 22, a baffle plate 23, an antenna 24, an L-lock cover 25, an electrical lock 26, a L-lock hook 27, a rubber ring bottom 28, a rubber ring top 29, an L-hook container 30, an L-hook plate 31, a battery 32.

Control Box

Figure 8:
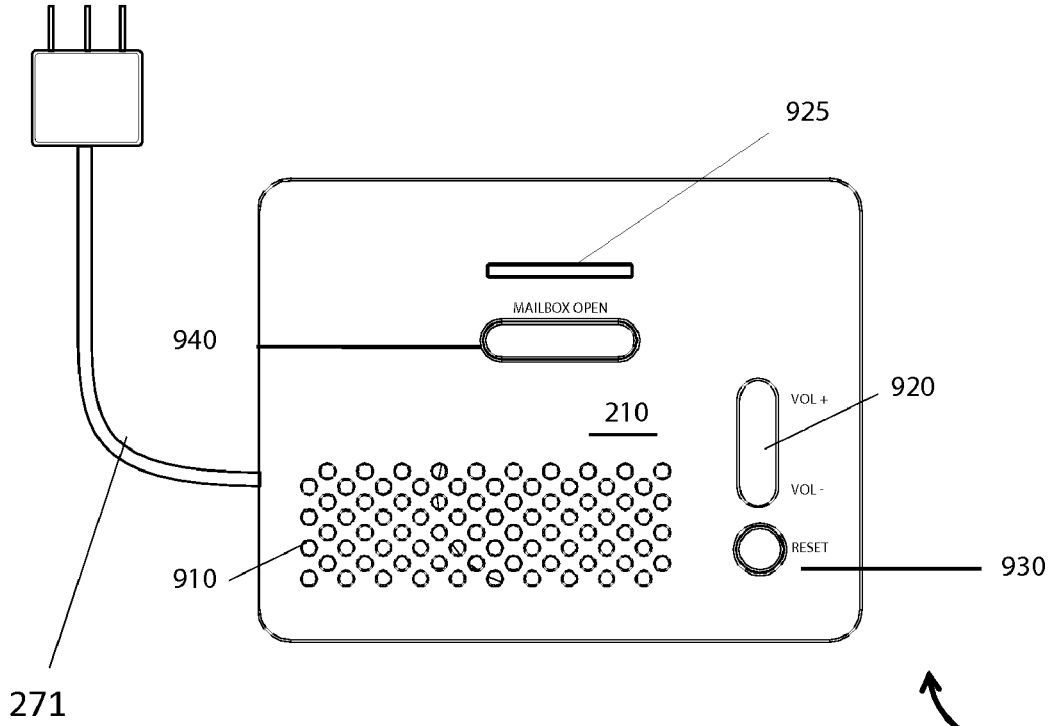
FIG. 8 is a front view of a control box of the system of the present invention.
Figure 9:
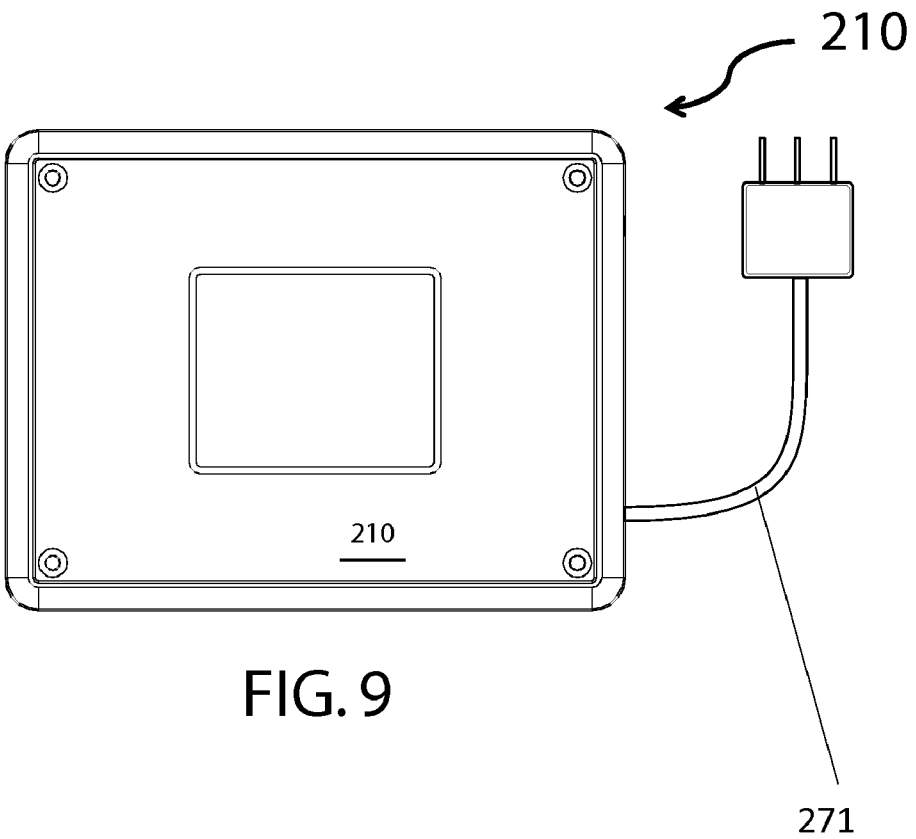
FIG. 9 is a rear view of the control box of FIG. 8.
Figure 10:
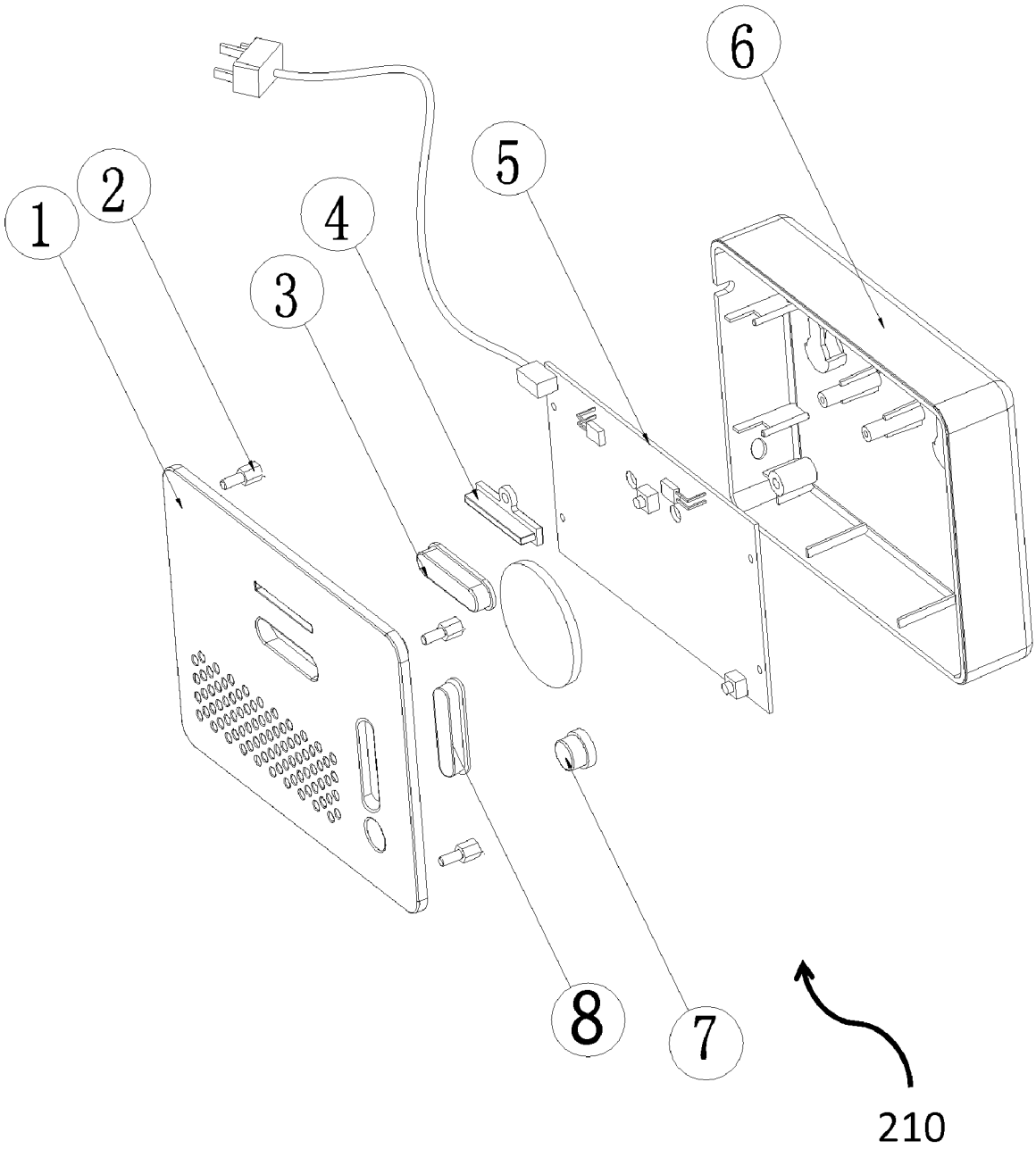
FIG. 10 is an exploded view of the control box of FIG. 8.
Figure 11:
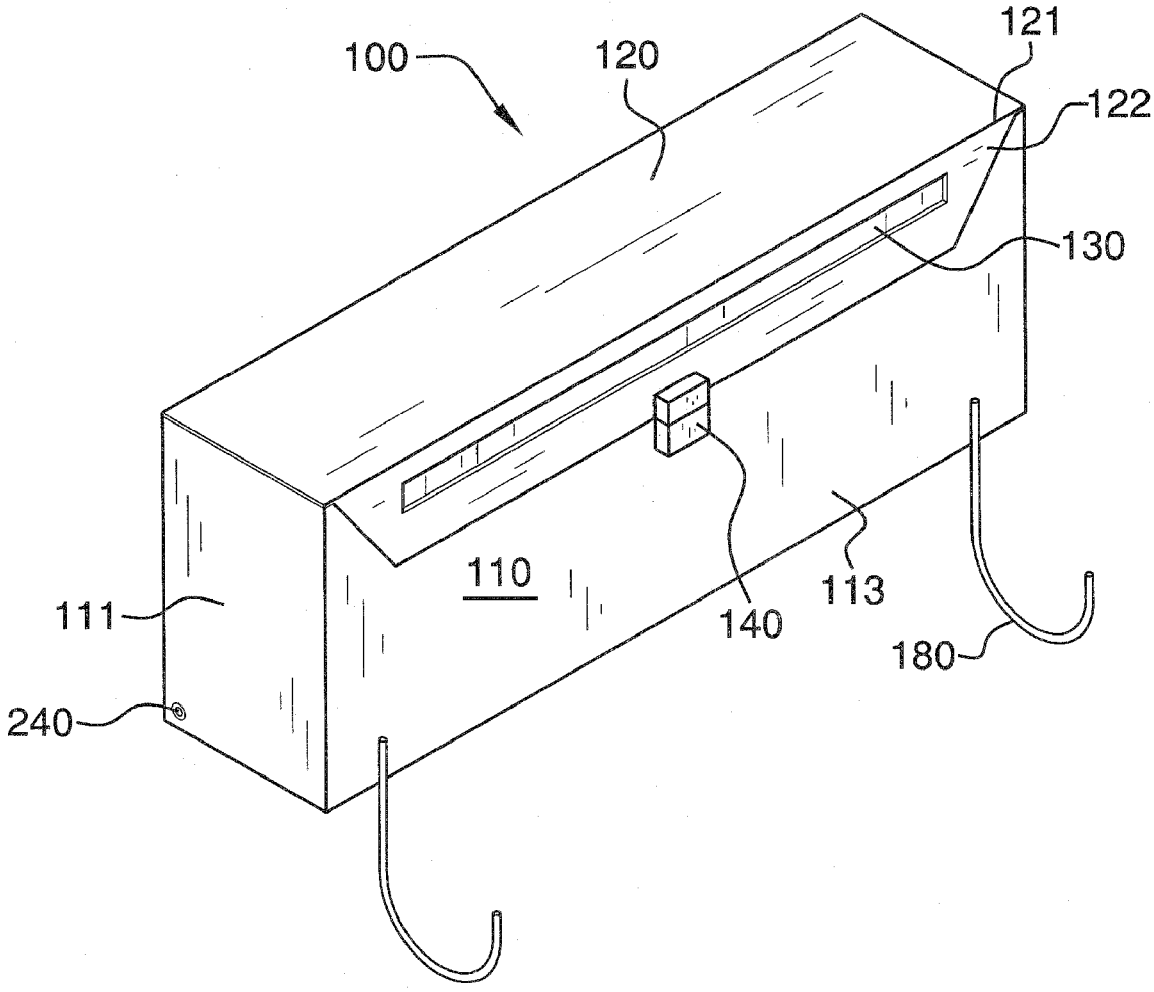
FIG. 11 is a front perspective view of an alternative embodiment of a mailbox housing of the system of the present invention.
Figure 14:
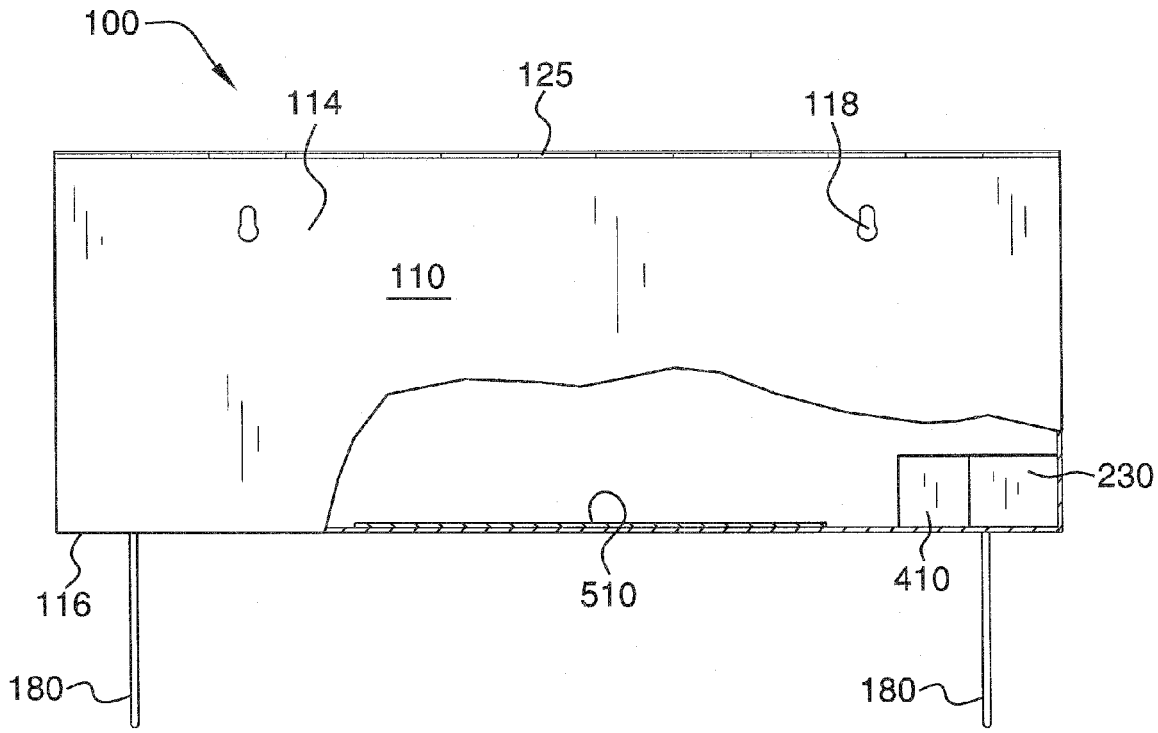
FIG. 14 is a rear and partial internal view of the mailbox housing of FIG. 11.
Figure 15:
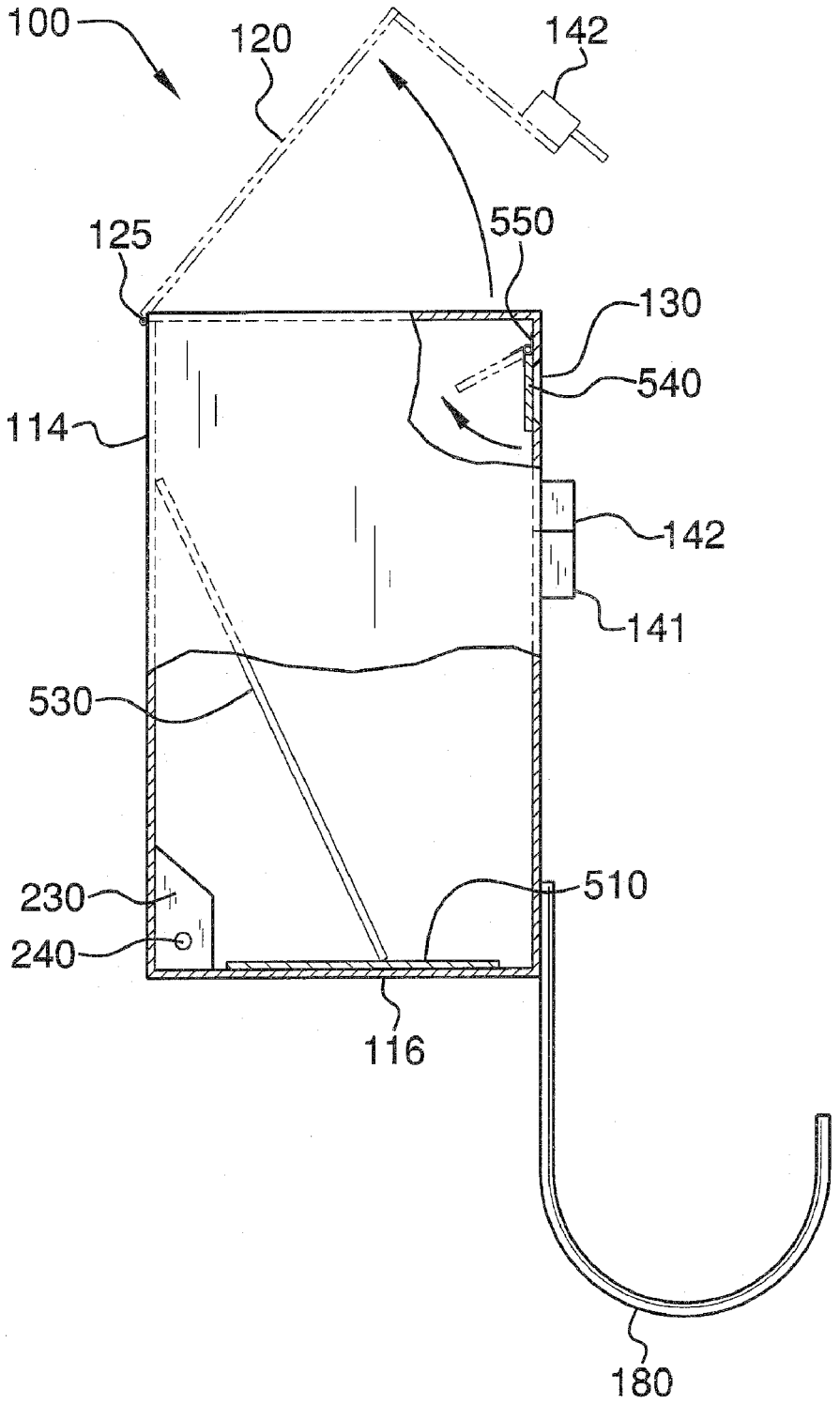
FIG. 15 is a side cross sectional view of the mailbox housing of FIG. 11.
Figure 16:
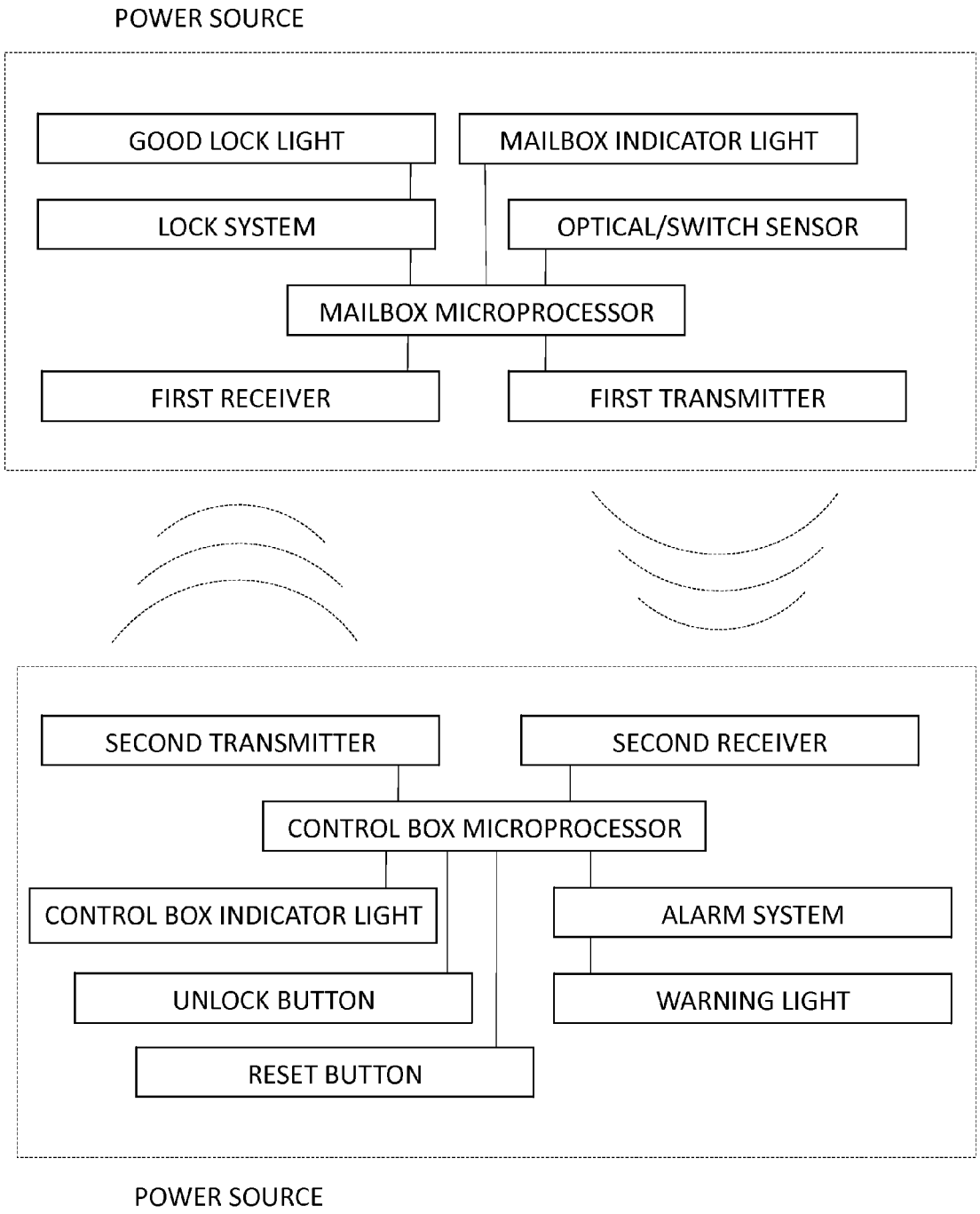
FIG. 16 is a schematic representation of electrical components of the system of the present invention.

Referring now to FIG. 8-10, the control box 210 may be placed a certain distance away from the mailbox housing 110 (e.g., in the home of the user). The control box 210 has a front surface, a back surface, a first side, a second side, a top surface, a bottom surface, and an inner cavity. Disposed in the control box 210 is a control box microprocessor operatively connected to the second receiver and to a second transmitter. The control box 210 is operatively connected to a control box indicator light 925. In some embodiments, the control box microprocessor is operatively connected to an alarm system (with speaker 910), which functions to alert a user that mail has been delivered to the mailbox housing 110.

The second receiver is configured to send a second receiver input signal to the control box microprocessor when the second receiver receives the first transmitter signal from the first transmitter. When the control box microprocessor receives the first transmitter signal from the second receiver, the control box microprocessor generates a second light output command to the control box indicator light to activate the control box indicator light (see FIG. 17A). This can alert the user that mail has arrived in the mailbox housing.

Figure 17A:
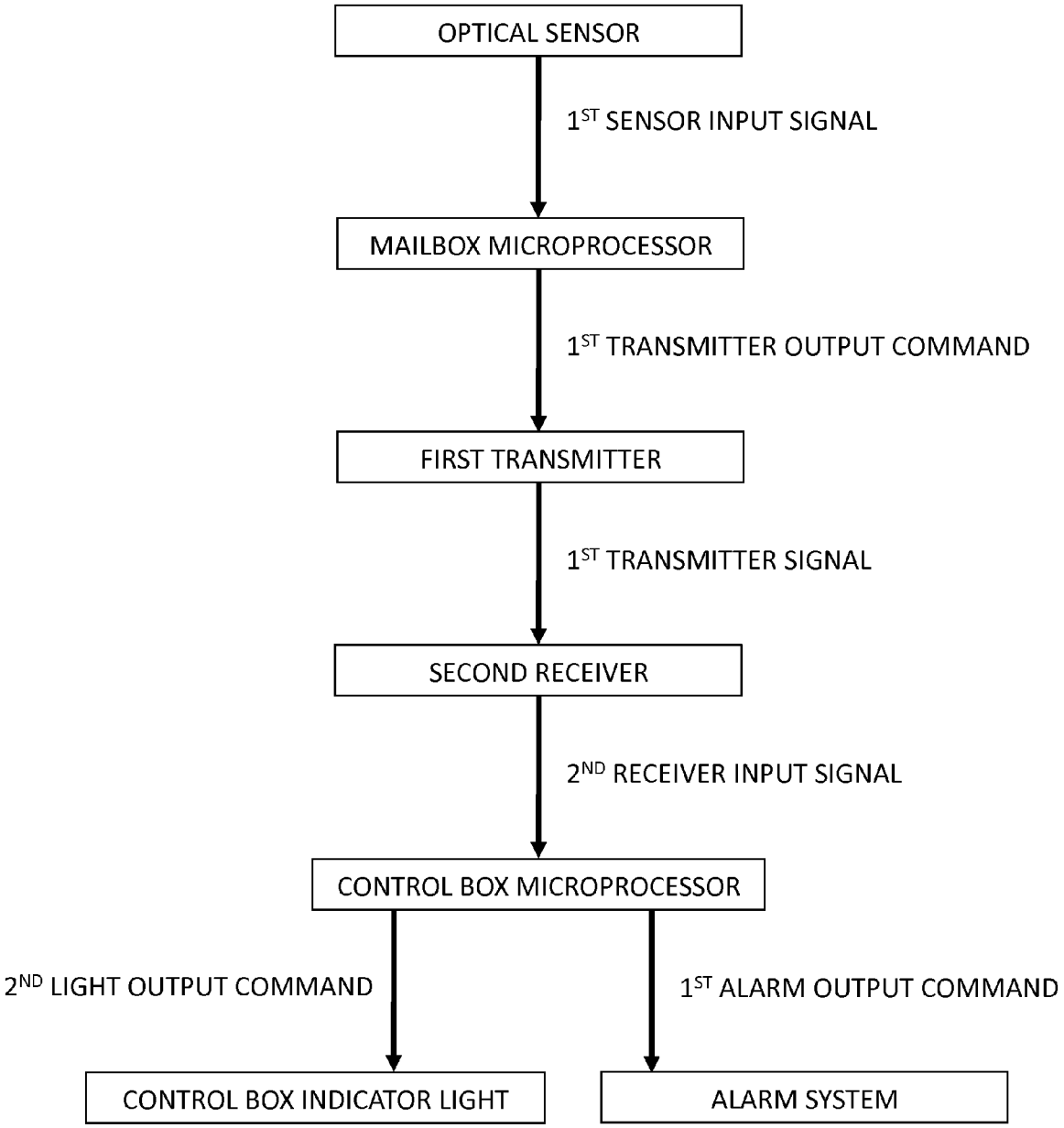
FIG. 17A-E are schematic representations of input signals and output commands of the system of the present invention.
Figure 17B:
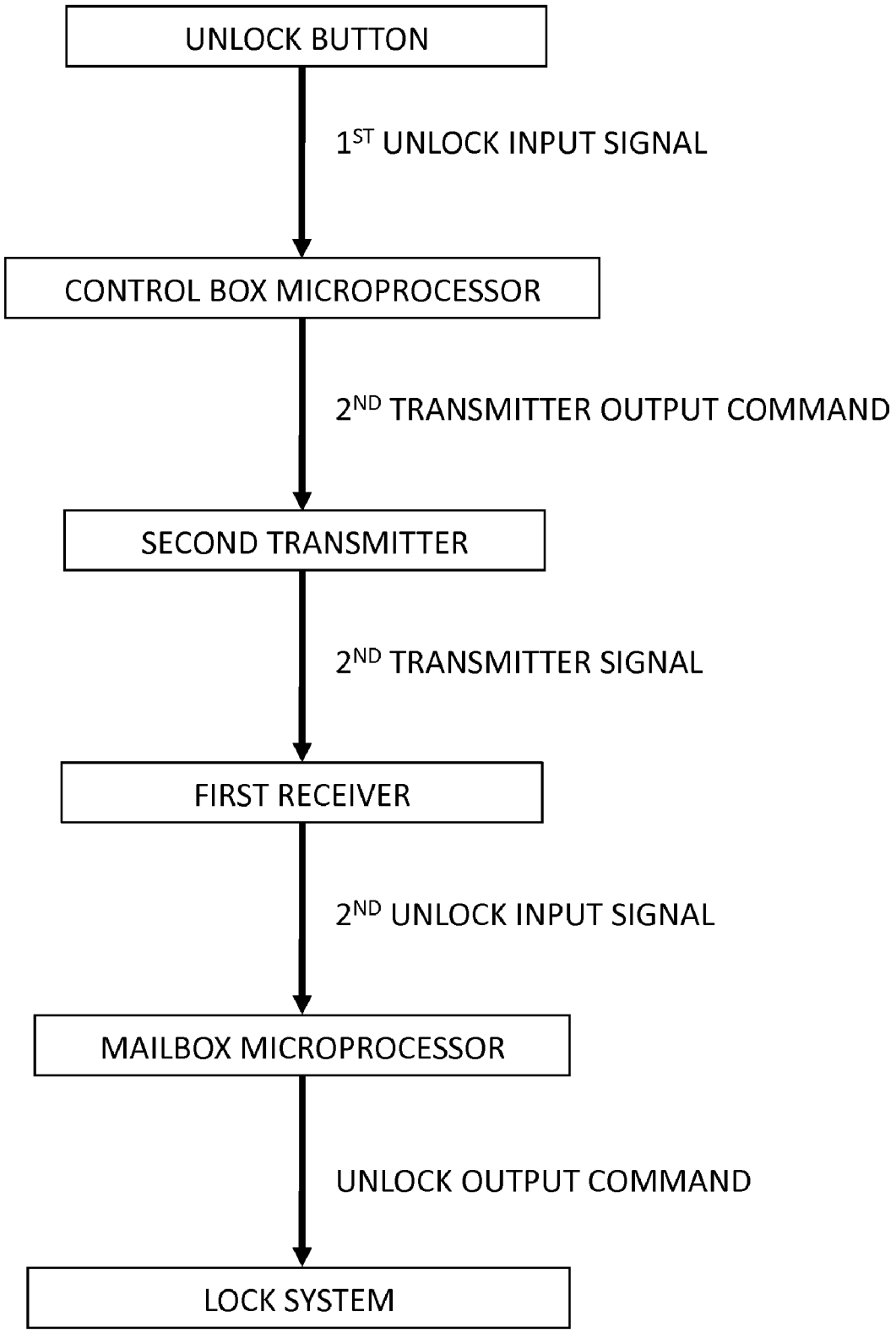
Figure 17C:
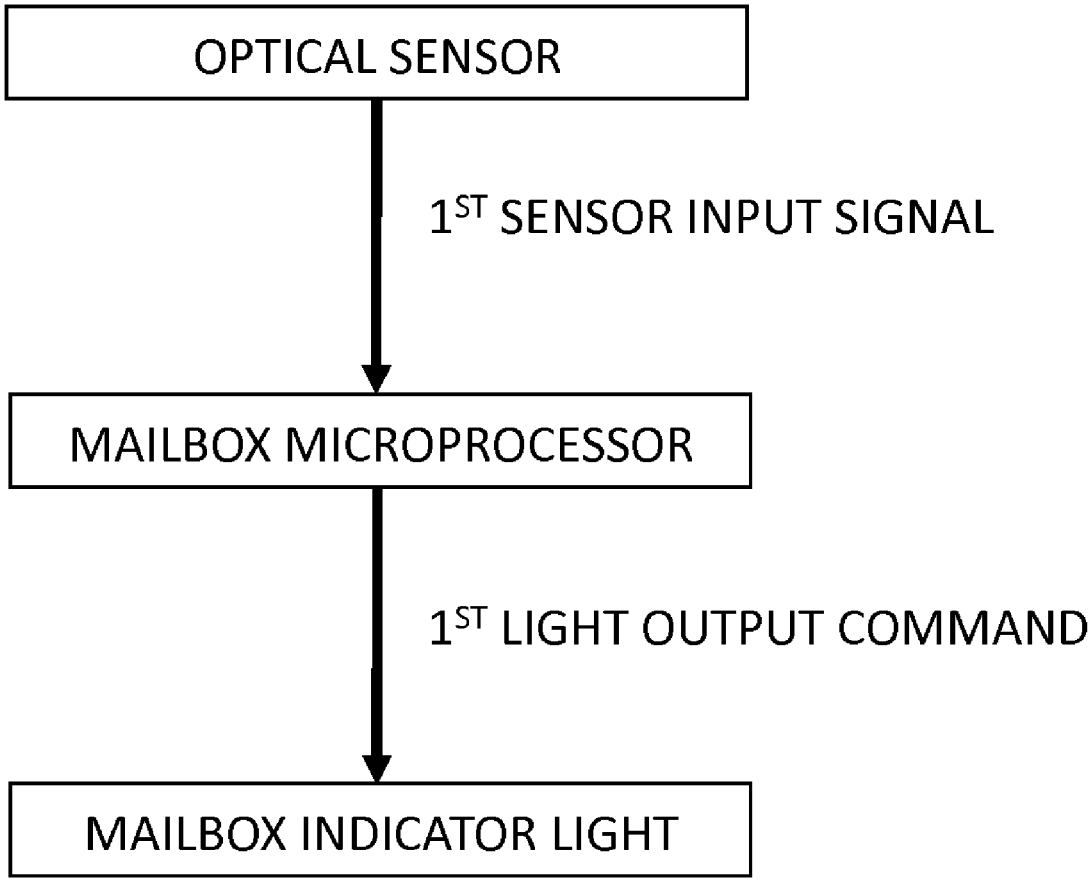
Figure 17D:
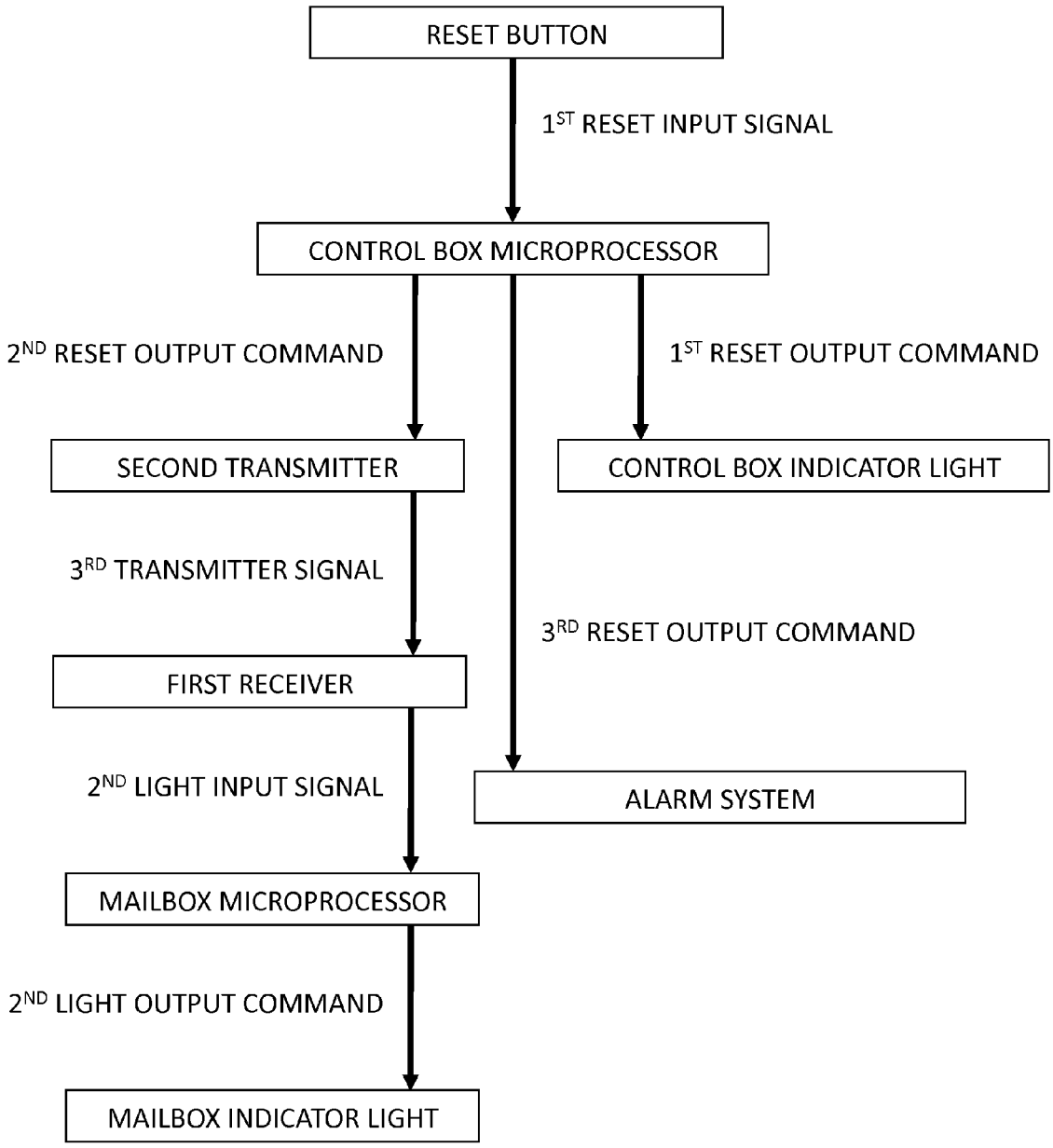
Figure 17E:
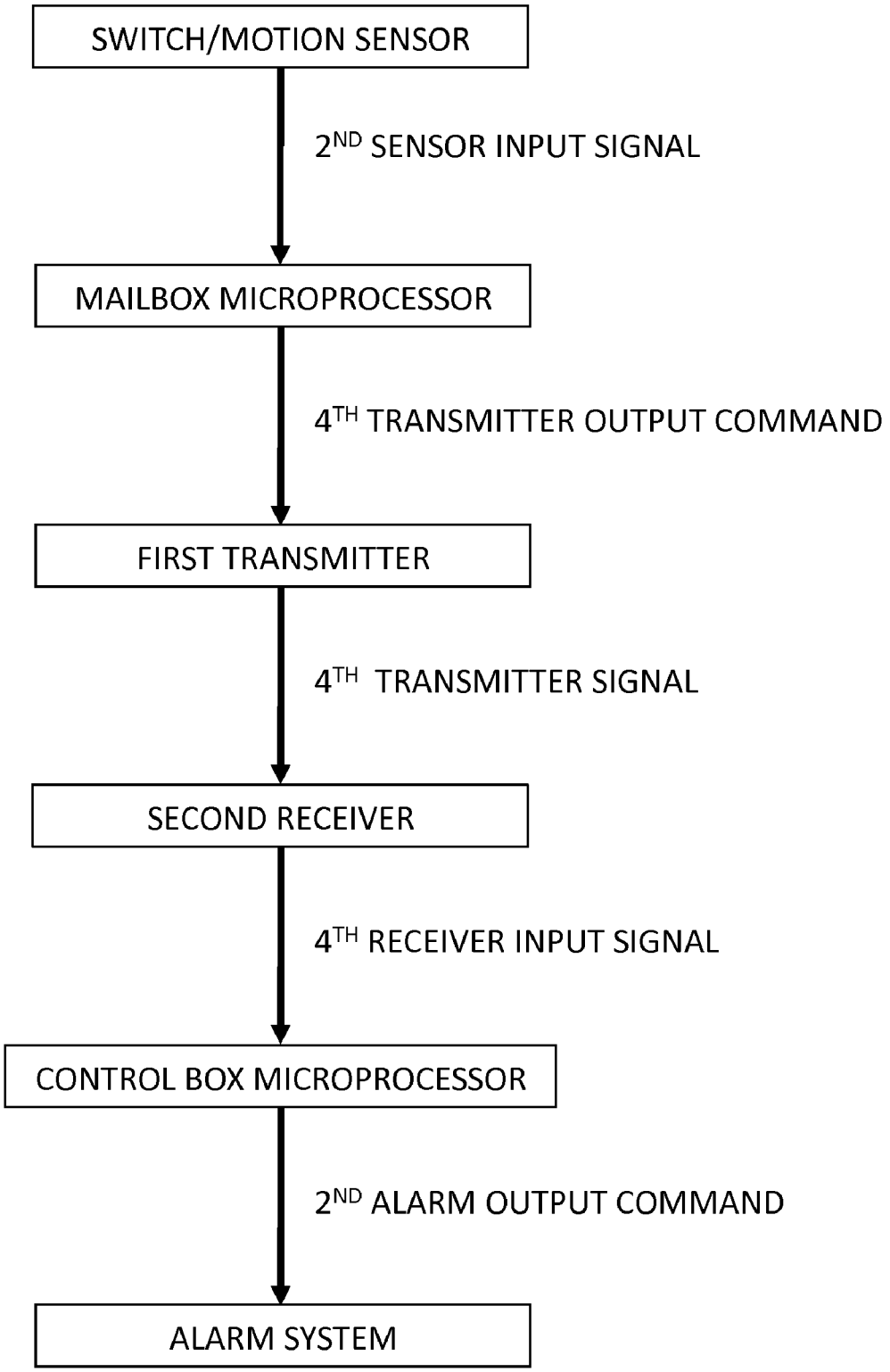
Figure 18:
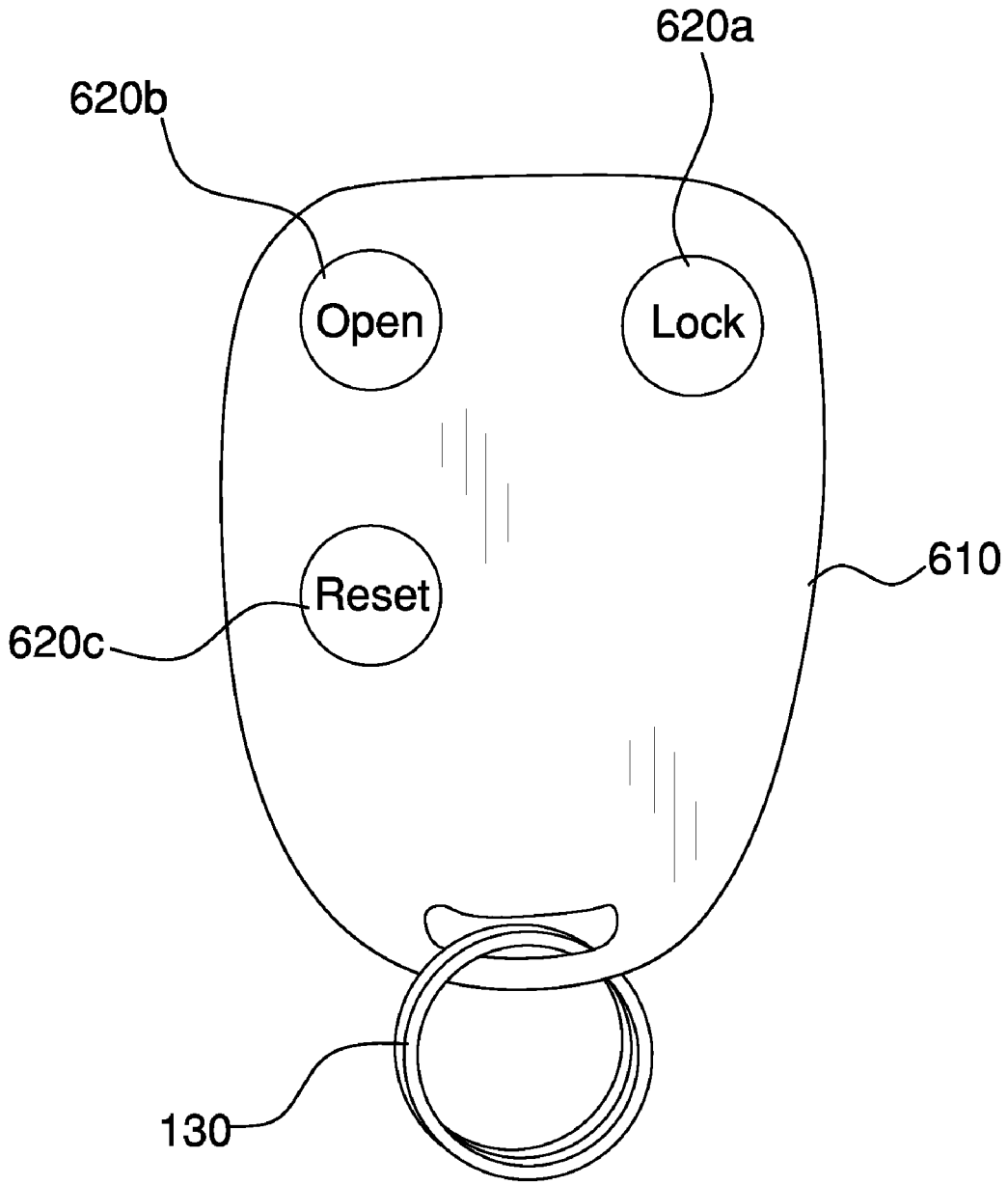
FIG. 18 is a front view of an example of a remote control for the system of the present invention.
Figure 19:
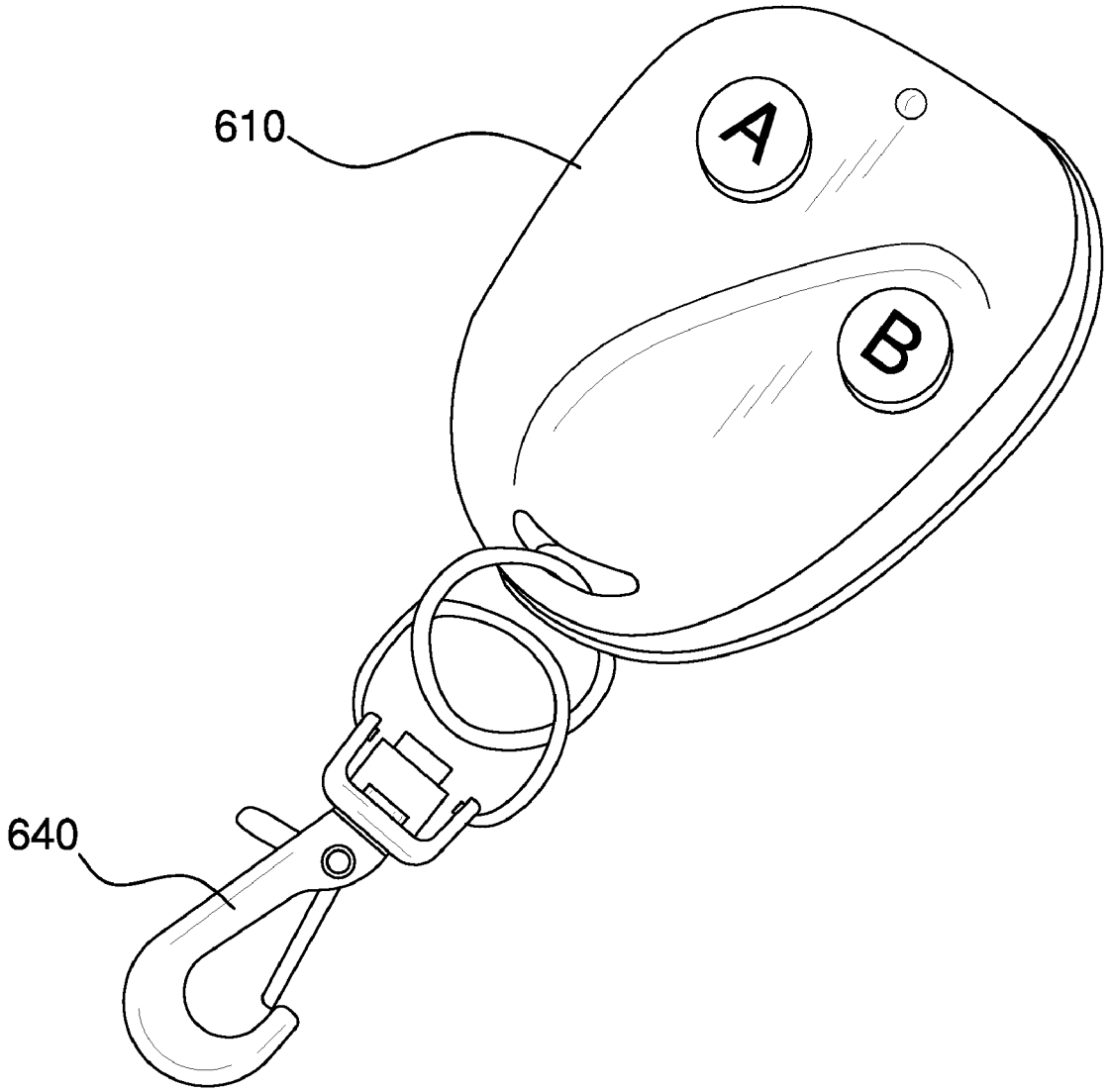
FIG. 19 is a perspective view of alternative examples of remote controls for the system of the present invention.

In some embodiments, upon receipt of the second receiver input signal, the control box microprocessor is configured to generate a first alarm output command to the alarm system to activate the alarm system (see FIG. 17A).

In some embodiments, the control box microprocessor is operatively connected to an unlock button 940 (e.g., disposed on the front surface of the control box) for unlocking the lock system on the mailbox housing. For example, the control box microprocessor is configured to receive a first unlock input signal from the unlock button 940 and generate a second transmitter output command to the second transmitter. The second transmitter is configured to send a second transmitter signal to the first receiver in the mailbox housing 110. When the first receiver receives the second transmitter signal, the first receiver sends a second unlock input signal to the mailbox microprocessor. Upon receipt of the second unlock input signal, the mailbox microprocessor generates an unlock output command to the lock system so as to unlock the lock system (see FIG. 17B).

In some embodiments, the unlock button 940 comprises a keypad system, wherein a user can pre-program a unique code for unlocking the lock system. Such keypad systems for unlocking other systems are well known to one of ordinary skill in the art.

In some embodiments, the microprocessor is operatively connected to a reset button 930. Reset buttons are well known to one of ordinary skill in the art. For example, in some embodiments, the control box microprocessor is configured to receive a first reset input signal from the reset button when the reset button is pressed. Upon receipt of the first reset input signal, the control box microprocessor can generate a first reset output command to the control box indicator light to cause the control box indicator light to become deactivated (see FIG. 17D).

In some embodiments, when the control box microprocessor receives the first reset input signal the control box microprocessor generates a second reset output command to the second transmitter to cause the second transmitter to send a third transmitter signal to the first receiver. Then, the first receiver can send a second light input signal to the mailbox microprocessor, whereupon the mailbox microprocessor generates a second light output command to the mailbox indicator light to deactivate the mailbox indicator light (see FIG. 17D).

In some embodiments, when the control box microprocessor receives the first reset input signal the control box microprocessor generates a third reset output command to the alarm system to deactivate the alarm system.

In some embodiments, one or more volume buttons 920 are disposed on the control box 210. The volume buttons 920 regulate the volume of the alarm system, for example.

The control box microprocessor may be operatively connected to the various components (e.g., second transmitter, alarm system, etc.) via one or more circuit boards (e.g., a printed circuit board, see FIG. 10)

The control box 210 may be placed on a table (e.g., in a living room). The control box 210 may be plugged into an electrical outlet via a second power cord 271 (see FIG. 9). The present invention is not limited to this arrangement. For example, in alternative embodiments, one or more mounting holes (or mounting slots) are disposed on the control box (e.g., the back surface), which allow the control box to be mounted on a surface such as a wall, etc.

FIG. 10 shows an exploded view of a control box 210 comprising a front surface 1, a hex pin 2, a reset button 3, a LED lens 4 (of the reset button 3), a printed circuit board (PCB) monitor 5, a back surface 6 (of the control box), an unlock button 7, and volume buttons 8.

The system 100 of the present invention (e.g., the mailbox housing 110 and/or the control box 210) may be constructed from a variety of materials. For example, in some embodiments, the mailbox housing 110 and/or control box 210 is constructed from a material comprising a metal, a plastic, wood, the like, or a combination thereof.

The components of the system (e.g., mailbox microprocessor, control box microprocessor, alarm system, indicator lights, transmitters, receivers, etc.) may be powered by a power source, for example a battery or an electrical outlet. FIG. 2, FIG. 4A, FIG. 4B, FIG. 5, and FIG. 6 show the mailbox comprising a first power cord 270. FIG. 8, FIG. 9, and FIG. 10 show the control box 210 comprising a second power cord 271. In some embodiments, the battery includes a lithium battery.

To use the system 100 of the present invention, the system 100 is first installed. For example, the AC socket of the control box 210 is plugged in to provide power to the control box 210 and the AC socket of the mailbox housing 110 is plugged in to provide power to the mailbox housing 110. When a piece of mail (e.g., postcard, regular envelope) is dropped into mailbox housing 110 via the slot 130, the control box indicator light 925 (e.g., LED light) on the control box 210 becomes illuminated to signal to the user that he/she has mail (e.g., the LED light may flash in a green color). In some embodiments, the alarm system is activated. The user can press the unlock button (e.g., labeled with "OPEN MAILBOX BUTTON"), which unlocks the lock system (e.g., the electromagnetic lock) so that the lid can be opened and the mail retrieved. The reset button can be pressed to turn the indicator light back off (or optionally the alarm system). If the user is not ready to pick the mail up immediately, the user can press the reset button to turn off the control box indicator light (e.g., the LED light). The lock system does not become unlocked.

Figure 7A:
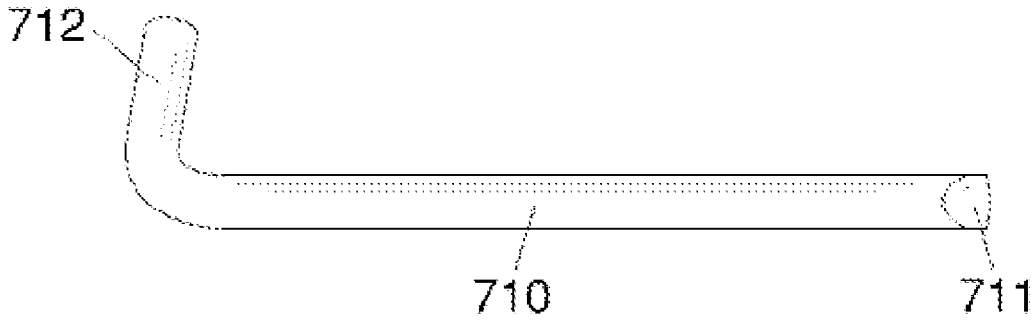
FIG. 7A is a perspective view of a tool key of the system of the present invention.
Figure 7B:
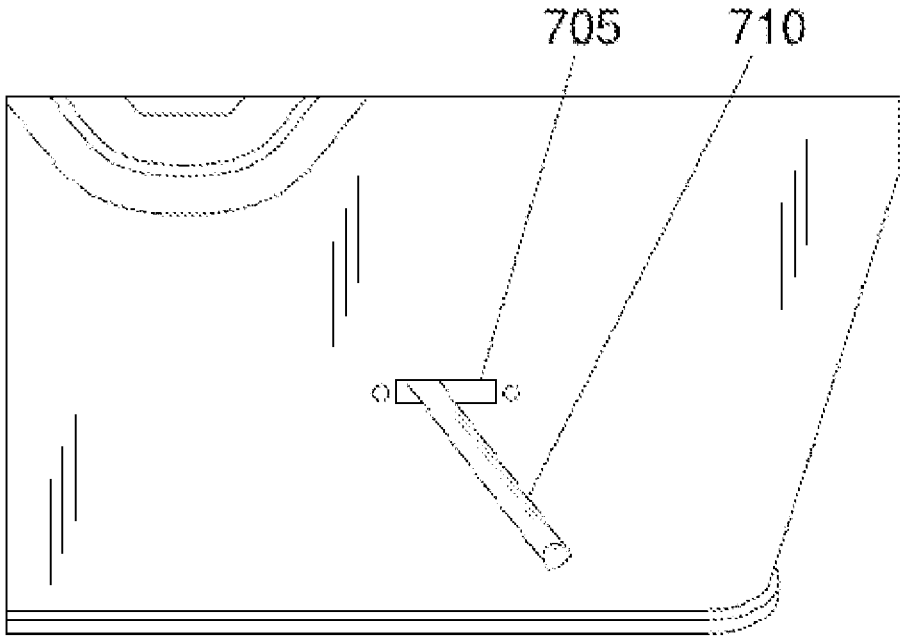
FIG. 7B is an in-use view of the tool key of the system of the present invention.

If the mailbox housing 110 needs to be unlocked in an emergency, the logo plate 735 can be removed (e.g., the screw unscrewed) via a first end 711 of a tool key 710 (see FIG. 7A, FIG. 7B). The second end 712 of the tool key 710 is inserted into a lock release hole 705 in the housing 110 covered by the logo plate. When the lock release hole 705 is reached, the key 710 can be turned clockwise to open the lock system. In some embodiments, as soon as the lid 120 is opened, the alarm system is activated. The reset button can be pressed to stop the alarm system.

In case a user presses the unlock button but does not come to pick up the mail right away, the lock system will engage an auto-lock function in a certain length of time (e.g., 10 minutes). The lock system (e.g., electromagnetic lock) will relock so the lid 120 is locked again. In some embodiments, if the lock does not become relocked, the alarm system is activated to alert the user that the lock is not locked properly.

Tampering or Theft Detection

In some embodiments, the system further comprises a switch sensor operatively connected to the mailbox microprocessor for detecting tampering (e.g., vandalism, tampering with the lock, etc.). Should someone try to vandalize the mailbox housing 110 or try to pry open lid 120 (e.g., without pressing the unlock button), then the alarm system becomes activated. In some embodiments, when the switch sensor detects tampering, the switch sensor sends a second sensor input signal to the mailbox microprocessor, whereupon the mailbox microprocessor generates a fourth transmitter output command to the first transmitter to cause the first transmitter to send a fourth transmitter signal to the second receiver. Upon receipt of the fourth transmitter signal, the second receiver sends a fourth receiver input signal to the control box microprocessor, whereupon the control box microprocessor generates a second alarm output command to the alarm system to activate the alarm system (see FIG. 17E). This alerts a user that the mailbox housing is being tampered with. In some embodiments, a warning light is illuminated on the control box 210 (see FIG. 8) if the mailbox housing is tampered with. The reset button can be pressed to turn the alarm system (and/or warning light) off.

In some embodiments, the alarm system is configured to emit various different sounds. For example, in some embodiments, the alarm system emits a first sound when the alarm system receives the first alarm output command (e.g., when mail arrives). In some embodiments, the alarm system emits a second sound when the alarm system receives the second alarm output command (e.g., if the system is being tampered with).

Alternative Embodiments

An alternative embodiment of the electronic mailbox system 100 is shown in FIGS. 11-15. For example, in some embodiments, the electronic mailbox system 100 comprises a mailbox housing 110 having a first side 111, a second side 112, a front surface 113, a back surface 114, and a bottom surface 116. A lid 120 is pivotally attached to the mailbox housing 110 via a hinge 125. The lid 120 has a front edge 121, wherein a lip 122 is perpendicularly attached such that it covers a portion of the front surface 113 of the mailbox housing 110. The lid 120 can move between an open position and a closed position via the hinge 125. Disposed in the lip 122 of the lid 120 and the front surface 130 of the mailbox housing 110 is a slot 130. The slot 130 allows mail to be inserted into the mailbox housing 110.

Disposed on the back surface 114 of the mailbox housing 110 is one or more mounting holes 118 for allowing a user to mount the mailbox housing 110 on a wall or similar surface. In some embodiments, one or more newspaper hooks 180 are attached to the bottom surface 116 (or other portion) of the mailbox housing 110. A newspaper can be attached to the newspaper hooks 180.

The lid 120 can be locked in the closed position via a lock 140. The lock 140 may be an electronic lock, and such electronic locks are well known to one of ordinary skill in the art. For example, see U.S. Pat. No. 6,107,934, the disclosure of which is incorporated in its entirety by reference herein. The lock 140 may be operatively connected to a power source (e.g., a battery).

In some embodiments, the lock 140 is attached to the lip 122 of the lid 120 and the front surface 113 of the mailbox housing 110. In some embodiments, the lock 140 comprises a male component 142 that locks into a female component 141. In some embodiments, the female component 141 is disposed on the front surface 113 of the mailbox housing 110 and the male component 142 is disposed on the lip 122 of the lid 120 (see FIG. 15). In some embodiments, the male component 142 is disposed on the front surface 113 of the mailbox housing 110 and the female component 142 is disposed on the lip 122 of the lid 120.

In some embodiments, an inner door 540 covers the slot 130 in the front surface 113 of the mailbox housing 110. The inner door 540 is attached to the inside surface of the front surface 113 of the mailbox housing 110 such that it covers the slot 130. The inner door 540 is moveable between an open position and a closed position, and the inner door 540 is biased in the closed position caused by a spring 550 attached to the inner door 540. The inner door 540 can help to prevent dirt, rain, or snow from leaking into the mailbox housing 110.

The mailbox housing 110 further comprises a mailbox microprocessor operatively connected to an optical sensor or a motion sensor 510 for detecting when a piece of mail 530 is inserted into the mailbox housing 110. The mailbox microprocessor is operatively connected to the first transmitter 410, the first receiver, and to the lock 140. The first transmitter 410 transmits signals to the second receiver in the control box 210.

The control box 210 comprises a control box microprocessor operatively connected to the second receiver and to a second transmitter. In some embodiments, the control box microprocessor is operatively connected to an alarm system with speaker 420 and to one or more control buttons 440, for example an unlock button 450 for unlocking the lock 140. In some embodiments, the control box microprocessor is operatively connected to an indicator light 430.

In some embodiments, the control buttons 440 are disposed on the front surface 213 of the control box 210. In some embodiments, the lock 140 can be unlocked via the unlock button 450.

In some embodiments, the mailbox microprocessor is operatively connected to an indicator light 430. For example, the indicator light 430 may include a light that is illuminated if mail is not present in the mailbox housing 110 and a light that is illuminated if mail is present in the mailbox housing 110. The alarm and speaker 420 and/or indicator light 430 can alert the user if a piece of mail 530 is inserted into the mailbox housing 110.

In some embodiments, the control buttons 440 may allow a user to control the volume of the alarm. In some embodiments, the control buttons 440 allow a user to reset the system.

Referring now to FIG. 18-22, the mailbox system 100 further comprises a remote control 610 for remotely operating the mailbox housing 110 and/or the control box 210. Remote control devices are well known to one of ordinary skill in the art. For example, many remote control devices are small and can be attached to other objects such as key rings via a linking component 640 (e.g., standard linking component for key rings). Disposed inside the remote control 610 is a remote control transmitter operatively connected to a remote control microprocessor. Remote control buttons are disposed on the remote control 610, for example a remote lock mailbox button 620*a*, a remote open mailbox button 620*b*, and a remote reset button 620*c*. The buttons 620 are operatively connected to the remote control microprocessor. The remote lock mailbox button 620*a* allows a user to lock the mailbox independently of the control box 210 (e.g., the user may wish to relock the mailbox housing after opening the mailbox housing, for example is he/she changes his/her mind about getting the mail). The remote open mailbox button 620*a* allows a user to open the mailbox housing 110 independently of the control box 210 (e.g., without having to go into the home where the control box 210 is). The remote reset button 620*c* allows a user to deactivate the alarm system independently of the control box 210.

In some embodiments, the remote control microprocessor is configured to receive a first remote lock button input signal from the remote lock mailbox button 620*a* when the remote lock mailbox button 620*a* is pressed. When the remote control microprocessor receives the first remote lock button input signal the remote control microprocessor sends a first remote transmitter output command to the remote control transmitter to cause the remote control transmitter to send a first remote transmitter signal to the first receiver in the mailbox housing 110. When the first receiver receives the first remote transmitter signal, the first receiver sends a first remote lock input signal to the mailbox microprocessor. Upon receipt of the first remote lock input signal, the mailbox microprocessor generates a first lock output command to the lock system so as to lock the lock system (see FIG. 21A).

In some embodiments, the remote control microprocessor is configured to receive a first remote open button input signal from the remote open mailbox button 620*b* when the remote open mailbox button 620*b* is pressed. When the remote control microprocessor receives the first remote open button input signal the remote control microprocessor sends a second remote transmitter output command to the remote control transmitter to cause the remote control transmitter to send a second remote transmitter signal to the first receiver in the mailbox housing 110. When the first receiver receives the second remote transmitter signal, the first receiver sends a second unlock input signal to the mailbox microprocessor. Upon receipt of the second unlock input signal, the mailbox microprocessor generates a first unlock output command to the lock system so as to unlock the lock system (see FIG. 21B).

In some embodiments, the remote control microprocessor is configured to receive a first remote rest button input signal from the remote reset button 620*c* when the remote reset button 620*c* is pressed. When the remote control microprocessor receives the first remote reset button input signal the remote control microprocessor sends a third remote transmitter output command to the remote control transmitter to cause the remote control transmitter to send a third remote transmitter signal to the second receiver in the control box 210. When the second receiver receives the third remote transmitter signal, the second receiver sends a fifth receiver input signal to the control box microprocessor. Upon receipt of the fifth receiver input signal, the control box microprocessor generates a fifth reset output command to the alarm system so as to reset the alarm system (see FIG. 21D).

The remote control 610 comprises a power source, for example a battery (e.g., standard battery, rechargeable battery).

In some embodiments, the control box 210 further comprises a control box lock button 690 (see FIG. 20, FIG. 22) for allowing a user to lock the mailbox housing 110 from the control box 210. The control box lock button 690 is operatively connected to the control box microprocessor. The control box microprocessor is configured to receive a first control box lock input signal from the control box lock button 690 when the control box lock button 690 is pressed. Upon receipt of the first control box lock input signal, the control box microprocessor generates a fifth transmitter output command to the second transmitter to cause the second transmitter to send a fifth transmitter signal to the first receiver in the mailbox housing 110. When the first receiver receives the fifth transmitter signal, the first receiver send a first control box lock input signal to the mailbox microprocessor whereupon the mailbox microprocessor generates the first lock output command to the lock system to lock the lock system (see FIG. 21C).

As stated previously, the mailbox housing 110 may need to be unlocked in an emergency (see mechanism above). In some embodiments, when the mailbox housing 110 is unlocked in this manner (e.g., if the tool key is inserted), the alarm system is activated. The reset button can be pressed to stop the alarm system (or the remote reset button can be pressed).

As used herein, an embodiment wherein the power source is a battery includes an embodiment wherein the power source is a rechargeable battery.

Figure 20:
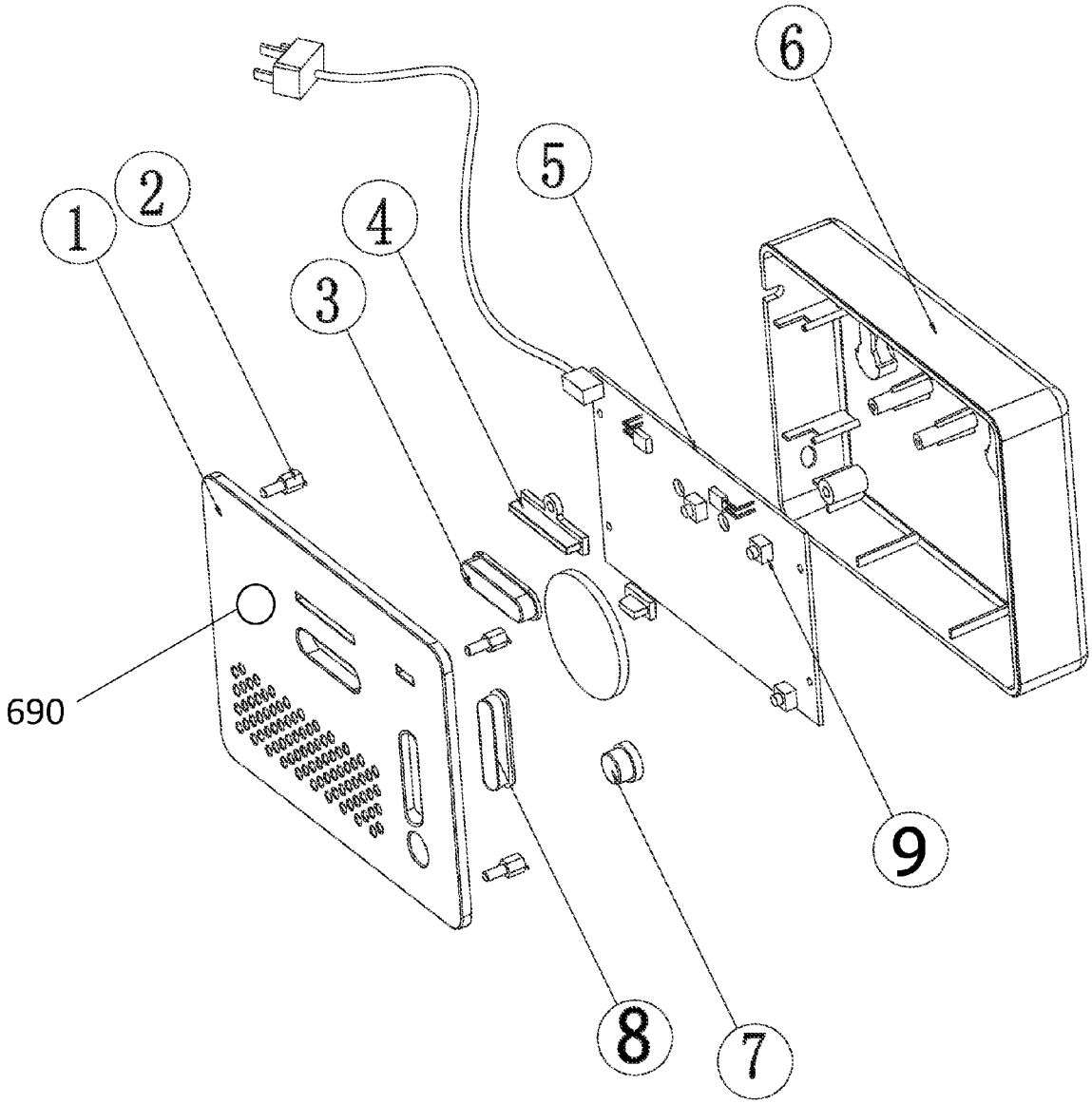
FIG. 20 is an exploded view of an alternative control box of the system of the present invention (with a lock button 690, with a secondary light component 9).
Figure 21A:
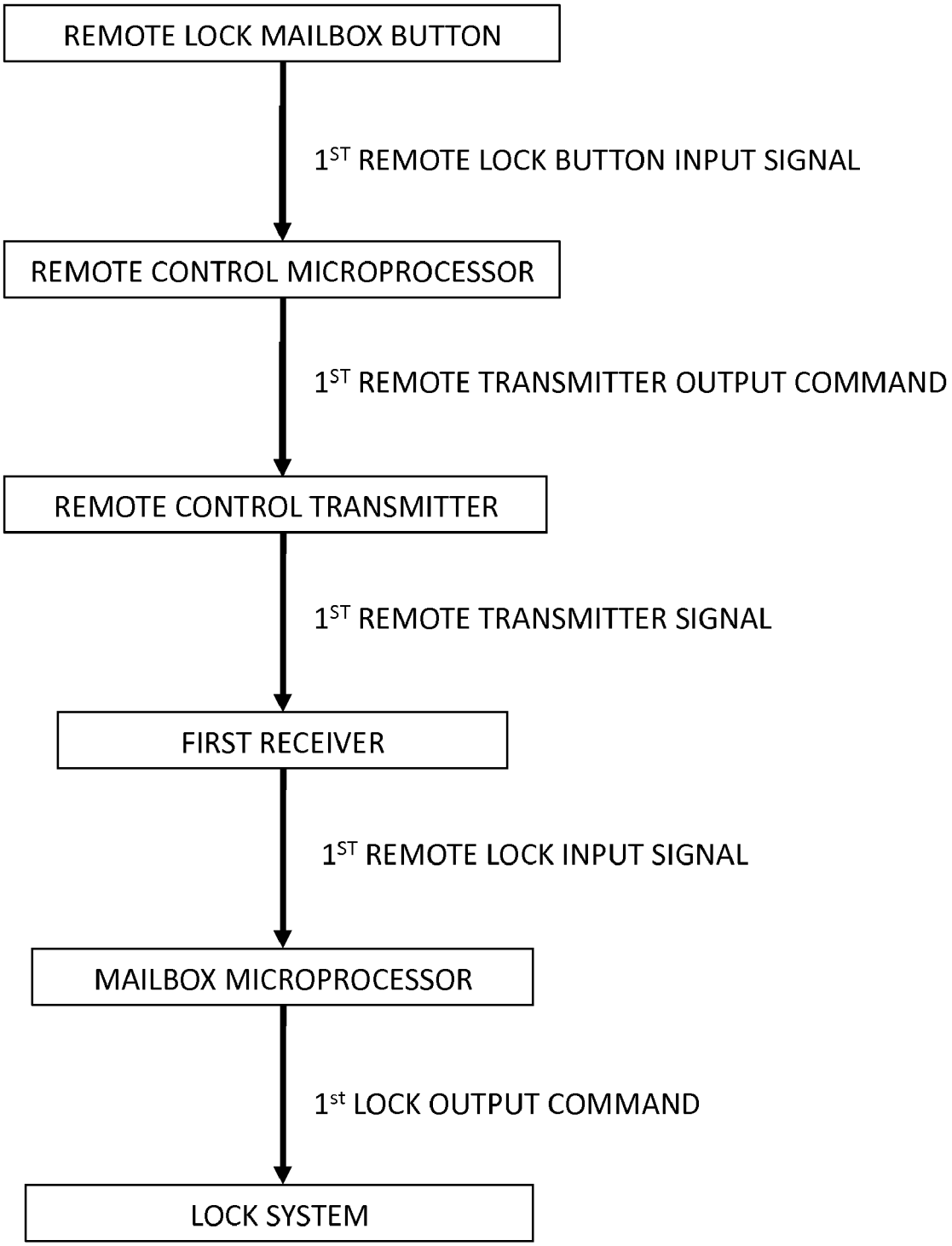
FIG. 21A-D are schematic representations of input signals and output commands of the system of the present invention.
Figure 21B:
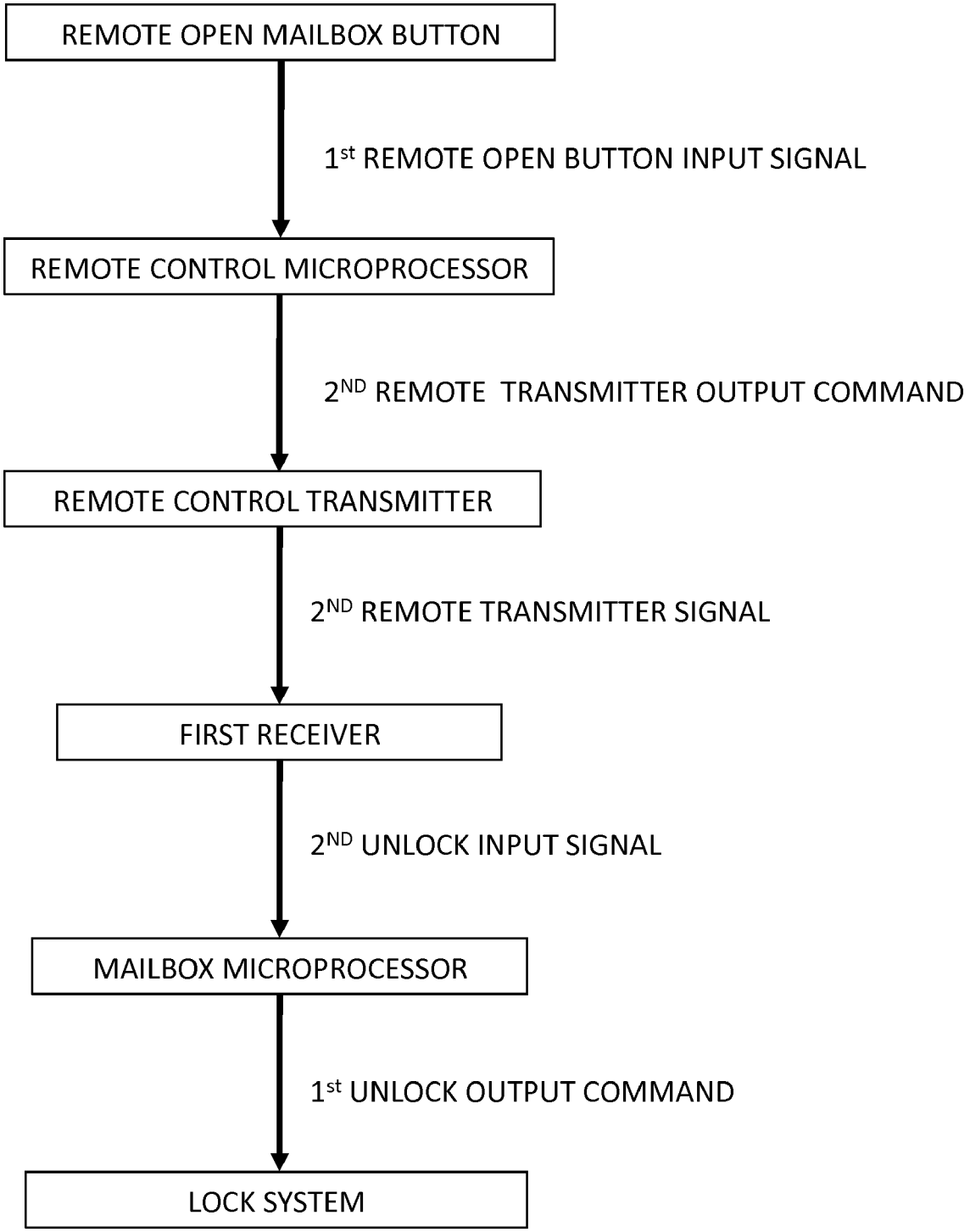
Figure 21C:
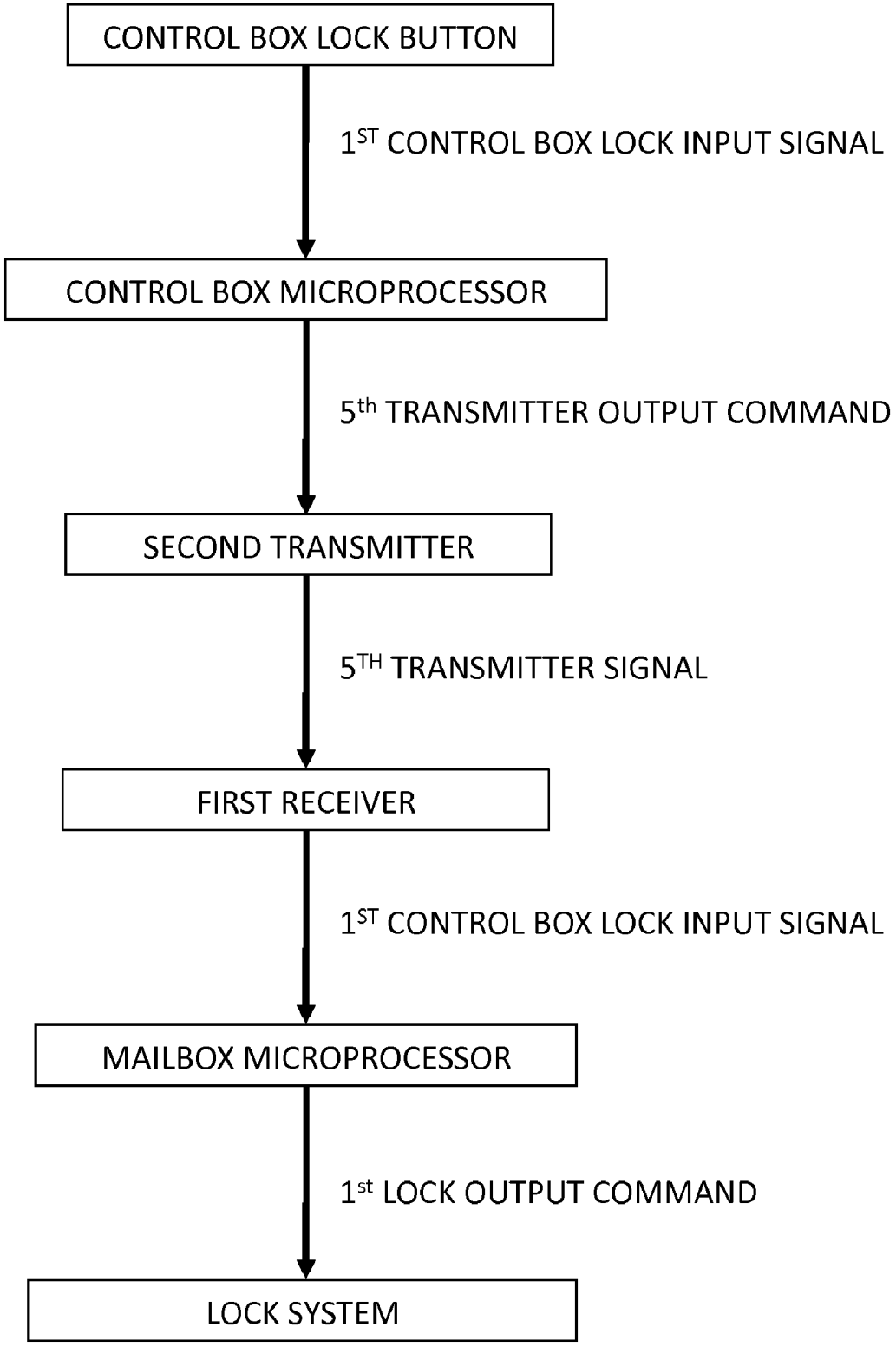
Figure 21D:
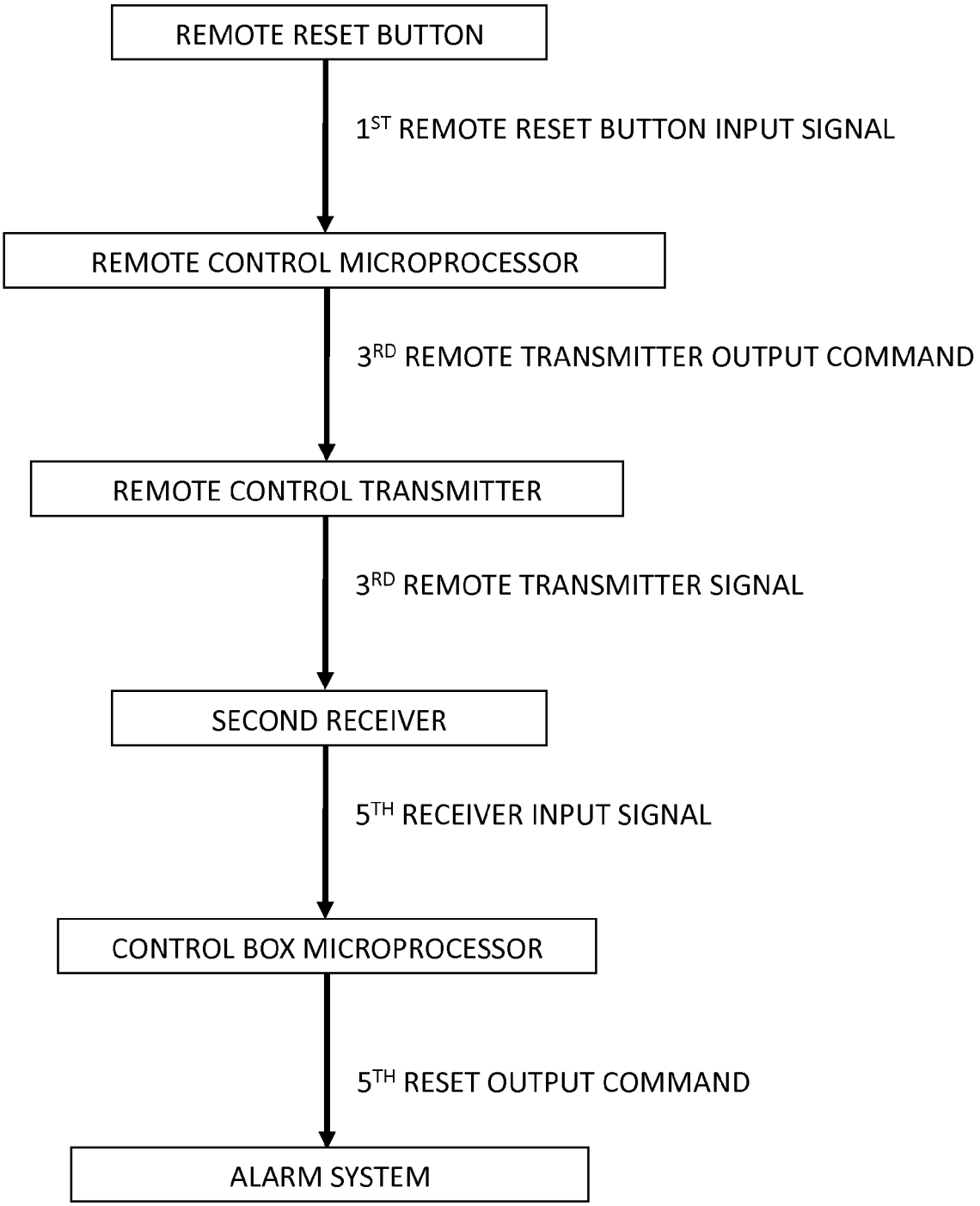
Figure 22:
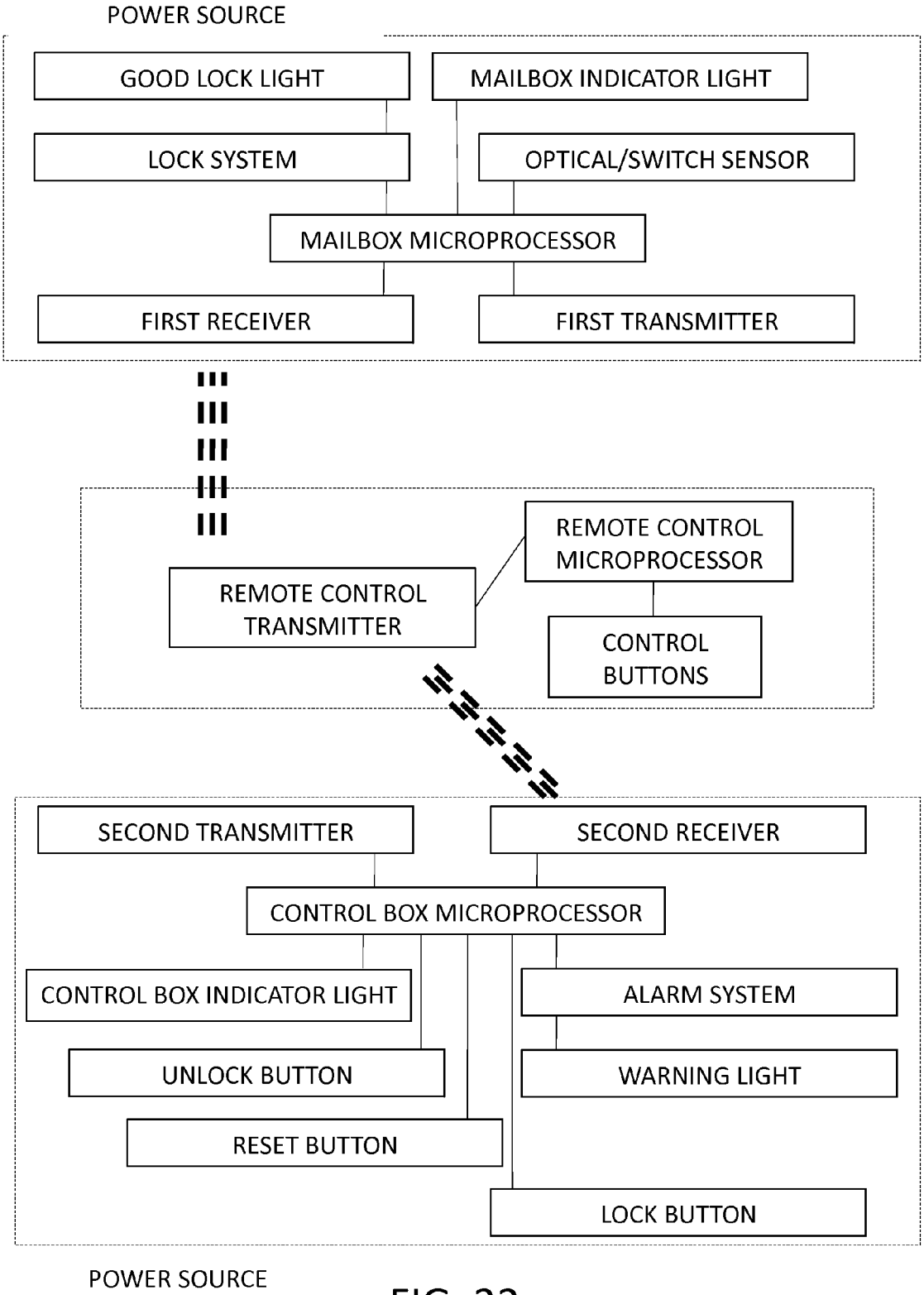
FIG. 22 is a schematic representation of electrical components of the system of the present invention including a remote control.

Referring now to FIG. 20, shows an exploded view of a control box 210 comprising a front surface 1, a hex pin 2, a reset button 3, a LED lens 4 (of the reset button 3), a printed circuit board (PCB) monitor 5, a back surface 6 (of the control box), an unlock button 7, and volume buttons 8. In some embodiments, the control box 210 further comprises a secondary light component (LED) 9. The secondary light component 9 in FIG. 20 may be operatively connected to the control box microprocessor. The secondary light component 9 in FIG. 20 may be illuminated (e.g., a red color) when the control box 210 is plugged in. In some embodiments, the secondary light component 9 in FIG. 20 flashes or blinks (e.g., a red color) when the alarm is activated.

Figure 23:
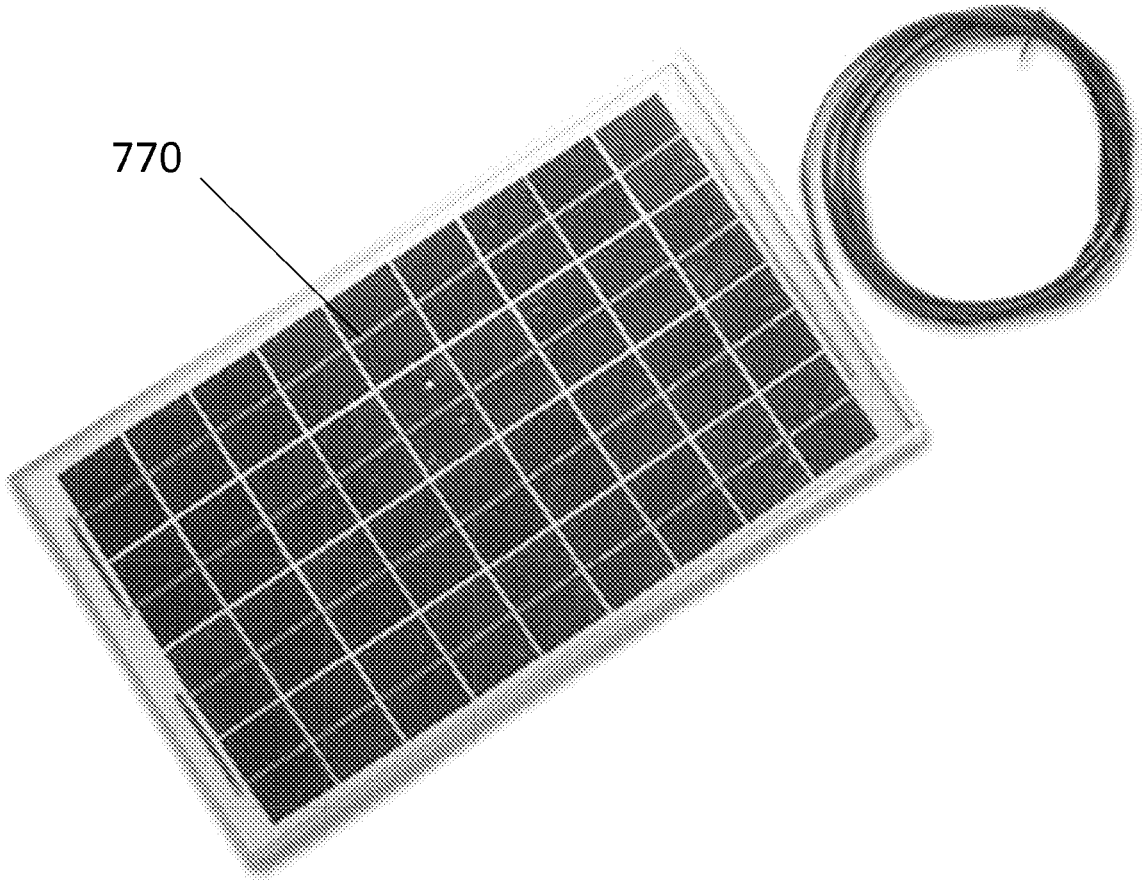
FIG. 23 is a perspective view of a solar panel.

Referring now to FIG. 23, in some embodiments, the system 100 of the present invention utilizes solar power. For example, in some embodiments, one or more solar panels 770 are operatively connected to one or more components of the system 110, for example the mailbox microprocessor and/or the optical switch/sensor and/or the mailbox indicator light and/or the lock system and/or the good lock light and/or the first receiver and/or the second receiver, etc. The solar panels 770 can provide power to the components of the system 100. Solar panels are well known to one of ordinary skill in the art. The solar panels 770 may be used for providing power directly to the components, or the solar panels 770 may be operatively connected to a rechargeable battery and provide power for the battery. The use of solar panels is not limited to the aforementioned examples.

In some embodiments, a single light (light 860, good lock light) is disposed on the mailbox housing, wherein the light can be illuminated in two or more colors (e.g., red, green). In some embodiments, when the lock system is unlocked, the light 860 (good lock light) turns red, and when the lock system is locked the light 860 (good lock light) is green. In some embodiments, when the mailbox housing is plugged in the light 860 is green. The lights of the system 100 of the present invention are not limited to this configuration, color, etc.

The following are additional disclosures of the present invention:

1. An electronic mailbox system (100) comprising:

(a) a mailbox housing (110) comprising: (i) an inner cavity for holding a piece of mail (530); (ii) a lid (120) moveable between an open position and a closed position respectively allowing and preventing access to the inner cavity; (iii) an electrically-operable lock system (26; 140) operatively connected to the lid, the lock system can move between a locked position which secures the lid in the closed position and an unlocked position which permits the lid to be moved to the open position; (iv) a slot (130) disposed in the mailbox housing for accommodating the piece of mail; (v) a mail sensor (510) for detecting the piece of mail being inserted into the slot; (vi) a first transmitter (410) and a first receiver; and (vii) a mailbox microprocessor operatively connected to each of the mail sensor, the lock system, the first transmitter, and the first receiver; and (b) a control box (210) comprising: (i) a second transmitter and a second receiver, wherein the second receiver is configured to receive signals from the first transmitter and the first receiver is configured to receive signals from the second transmitter; (ii) a control box indicator light (925); (iii) an unlock button (940; 7; 450); (iv) a reset button (930; 13); and (v) a control box microprocessor operatively connected to each the second transmitter, the second receiver, the control box indicator light, the unlock button, and the reset button;

wherein:

the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated;

the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position; and the control box microprocessor is configured to receive a first reset input signal from the reset button when the reset button is pressed whereupon the control box microprocessor generates a first reset output command to the control box indicator light to cause the control box indicator light to become deactivated.

2. A system as claimed in claim 1, wherein the mailbox housing further comprises a mailbox indicator light (60; 430) operatively connected to the mailbox microprocessor; and wherein when the mailbox microprocessor receives the first sensor input signal from the mail sensor the mailbox microprocessor generates a first light output command to the mailbox indicator light to activate the mailbox indicator light.

3. A system as claimed in claim 2, wherein when the control box microprocessor receives the first reset input signal from the reset button the control box microprocessor generates a second reset output command to the second transmitter to cause the second transmitter to send a third transmitter signal to the first receiver in the mailbox housing; and wherein the first receiver is configured to send a second light input signal to the mailbox microprocessor when the first receiver receives the third transmitter signal from the second transmitter, whereupon the mailbox microprocessor generates a second light output command to the mailbox indicator light to deactivate the mailbox indicator light.

4. A system as claimed in any preceding claim, wherein the control box further comprises an alarm system (910; 420) operatively connected to the control box microprocessor.

5. A system as claimed in claim 4, wherein when the control box microprocessor receives the second receiver input signal the control box microprocessor generates a first alarm output command to the alarm system to activate the alarm system.

6. A system as claimed in claim 4 or 5, wherein when the control box microprocessor receives the first reset input signal from the reset button the control box microprocessor generates a third reset output command to the alarm system to deactivate the alarm.

7. A system as claimed in any of claims 4 to 6, wherein:

the mailbox housing also includes a tamper sensor for detecting tampering of the mailbox housing and to which the mailbox microprocessor is operatively connected;

the mailbox microprocessor is configured to receive a second sensor input signal from the tamper sensor when the tamper sensor detects tampering, wherein upon receipt of the second sensor input signal the mailbox microprocessor generates a fourth transmitter output command to the first transmitter to cause the first transmitter to send a fourth transmitter signal to the second receiver, wherein upon receipt of the fourth transmitter signal, the second receiver sends a fourth receiver input signal to the control box microprocessor whereupon the control box microprocessor generates a second alarm output command to the alarm system to activate the alarm system; and the control box microprocessor is configured so that, upon receipt by the control box microprocessor of the first reset input signal, the control box microprocessor generates a third reset output command to the alarm system to deactivate the alarm.

8. A system as claimed in claim 7 when directly or indirectly dependent on claim 5, wherein the alarm system is configured to emit a first sound when the alarm system receives the first alarm output command and the alarm system is configured to emit a second sound when the alarm system receives the second alarm output command.

9. A system as claimed in any preceding claim, further comprising a newspaper holder (14; 880; 180) disposed on the mailbox housing.

10. A system as claimed in any preceding claim, wherein the mailbox housing further comprises an awning (7; 139) positioned over the slot to help prevent moisture from entering into the slot.

11. A system as claimed in any preceding claim, wherein the mailbox housing further comprises an inner door (540) attached to an inside surface of a front surface of the mailbox housing such that it covers the slot, the inner door is moveable between an open position and a closed position respectively allowing and preventing access to the inner cavity of the mailbox housing, the inner door is biased in the closed position caused by a spring (550).

12. A system as claimed in any preceding claim, wherein the lock system comprises a good lock light for indicating the lock system is in the locked position.

13. A system as claimed in any preceding claim, wherein the lock system comprises an emergency unlocking mechanism (735,710,705).

14. A system as claimed in any preceding claim, wherein the lock system comprises an auto-lock mechanism, the auto-lock mechanism function to causing the lock system to become locked after a certain length of time after the lock system has been unlocked.

15. A system as claimed in claim 14, wherein if the lock system is not relocked after the certain length of time the alarm system is activated.

Various modifications of the invention, in addition to those described herein, will be apparent to those skilled in the art from the foregoing description. Such modifications are also intended to fall within the scope of the appended claims.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An electronic mailbox system (100) comprising:

(a) a mailbox housing (110) comprising: (i) an inner cavity for holding a piece of mail (530); (ii) a lid (120) moveable between an open position and a closed position respectively allowing and preventing access to the inner cavity; (iii) an electrically-operable lock system (26; 140) operatively connected to the lid, the lock system can move between a locked position which secures the lid in the closed position and an unlocked position which permits the lid to be moved to the open position; (iv) a slot (130) disposed in the mailbox housing for accommodating the piece of mail; (v) a mail sensor (510) for detecting the piece of mail being inserted into the slot; (vi) a first transmitter (410) and a first receiver; (vii) a mailbox indicator light (60; 430); and (viii) a mailbox microprocessor operatively connected to each of the mail sensor, the mailbox indicator light, the lock system, the first transmitter, and the first receiver; and (b) a control box (210) comprising: (i) a second transmitter and a second receiver, wherein the second receiver is configured to receive signals from the first transmitter and the first receiver is configured to receive signals from the second transmitter; (ii) a control box indicator light (925); (iii) an unlock button (940; 7; 450); (iv) a reset button (930; 13); and (v) a control box microprocessor operatively connected to each the second transmitter, the second receiver, the control box indicator light, the unlock button, and the reset button;

wherein:

the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated;

the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position;

the control box microprocessor is configured to receive a first reset input signal from the reset button when the reset button is pressed whereupon the control box microprocessor generates a first reset output command to the control box indicator light to cause the control box indicator light to become deactivated;

the mailbox microprocessor is configured to generate a first light output command to the mailbox indicator light to activate the mailbox indicator light when the mailbox microprocessor receives the first sensor input signal from the mail sensor;

the control box microprocessor is configured to generate a second reset output command to the second transmitter to cause the second transmitter to send a third transmitter signal to the first receiver in the mailbox housing when the control box microprocessor receives the first reset input signal from the reset button;

and the first receiver is configured to send a second light input signal to the mailbox microprocessor when the first receiver receives the third transmitter signal from the second transmitter, whereupon the mailbox microprocessor generates a second light output command to the mailbox indicator light to deactivate the mailbox indicator light.

2. An electronic mailbox system (100) comprising:

(a) a mailbox housing (110) comprising: (i) an inner cavity for holding a piece of mail (530); (ii) a lid (120) moveable between an open position and a closed position respectively allowing and preventing access to the inner cavity; (iii) an electrically-operable lock system (26; 140) operatively connected to the lid, the lock system can move between a locked position which secures the lid in the closed position and an unlocked position which permits the lid to be moved to the open position; (iv) a slot (130) disposed in the mailbox housing for accommodating the piece of mail; (v) a mail sensor (510) for detecting the piece of mail being inserted into the slot; (vi) a first transmitter (410) and a first receiver; and (vii) a mailbox microprocessor operatively connected to each of the mail sensor, the lock system, the first transmitter, and the first receiver; and (b) a control box (210) comprising: (i) a second transmitter and a second receiver, wherein the second receiver is configured to receive signals from the first transmitter and the first receiver is configured to receive signals from the second transmitter; (ii) a control box indicator light (925); (iii) an unlock button (940; 7; 450); (iv) a reset button (930; 13); (v) an alarm system (910; 420); and (vi) a control box microprocessor operatively connected to each of the second transmitter, the second receiver, the control box indicator light, the unlock button, the reset button, and the alarm system;

wherein:

the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated;

the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position;

the control box microprocessor is configured to receive a first reset input signal from the reset button when the reset button is pressed whereupon the control box microprocessor generates a first reset output command to the control box indicator light to cause the control box indicator light to become deactivated;

the control box microprocessor is configured to generate a first alarm output command to the alarm system to activate the alarm system to indicate receipt of mail in the mailbox housing when the control box microprocessor receives the second receiver input signal;

the mailbox housing also includes a tamper sensor for detecting tampering of the mailbox housing and to which the mailbox microprocessor is operatively connected;

the mailbox microprocessor is configured to receive a second sensor input signal from the tamper sensor when the tamper sensor detects tampering, wherein upon receipt of the second sensor input signal the mailbox microprocessor generates a fourth transmitter output command to the first transmitter to cause the first transmitter to send a fourth transmitter signal to the second receiver, wherein upon receipt of the fourth transmitter signal, the second receiver sends a fourth receiver input signal to the control box microprocessor whereupon the contra box microprocessor generates a second alarm output command to the alarm system to activate the alarm system to indicate detection of tampering of the mailbox housing; and the control box microprocessor is configured so that, upon receipt by the control box microprocessor of the first reset input signal, the control box microprocessor generates a third reset output command to the alarm system to deactivate the alarm.

3. The system of claim 2, wherein the alarm system is configured to emit a first sound when the alarm system receives the first alarm output command and the alarm system is configured to emit a second sound when the alarm system receives the second alarm output command.

4. The system of claim 1, further comprising a newspaper holder (14; 880; 180) disposed on the mailbox housing.

5. The system of claim 1, wherein the mailbox housing further comprises an awning (7; 139) positioned over the slot to help prevent moisture from entering into the slot.

6. The system of claim 1, wherein the mailbox housing further comprises an inner door (540) attached to an inside surface of a front surface of the mailbox housing such that it covers the slot, the inner door is moveable between an open position and a closed position respectively allowing and preventing access to the inner cavity of the mailbox housing, the inner door is biased in the closed position caused by a spring (550).

7. The system of claim 1, wherein the lock system comprises a good lock light for indicating the lock system is in the locked position.

8. The system of claim 1, wherein the lock system comprises an emergency unlocking mechanism (735, 710, 705).

9. The system of claim 2, wherein the lock system comprises an auto-lock mechanism, the auto-lock mechanism function to causing the lock system to become locked after a certain length of time after the lock system has been unlocked.

10. The system of claim 9, wherein if the lock system is not relocked after the certain length of time the alarm system is activated.

11. The system of claim 1, wherein, the system is constructed from a material comprising a metal, a plastic, wood, or a combination thereof.

12. The system of claim 1 comprising a rechargeable battery.

13. An electronic mailbox system (100) comprising:

(a) a mailbox housing (110) comprising: (i) an inner cavity for holding a piece of mail (530); (ii) a lid (120) moveable between an open position and a closed position respectively allowing and preventing access to the inner cavity; (iii) an electrically-operable lock system (26; 140) operatively connected to the lid, the lock system can move between a locked position which secures the lid in the closed position and an unlocked position which permits the lid to be moved to the open position; (iv) a slot (130) disposed in the mailbox housing for accommodating the piece of mail; (v) a mail sensor (510) for detecting the piece of mail being inserted into the slot; (vi) a first transmitter (410) and a first receiver; (vii) a mailbox indicator light (60; 430); and (viii) a mailbox microprocessor operatively connected to each of the mail sensor, the mailbox indicator light, the lock system, the first transmitter, and the first receiver;

(b) a control box (210) comprising: (i) a second transmitter and a second receiver, wherein the second receiver is configured to receive signals from the first transmitter and the first receiver is configured to receive signals from the second transmitter; (ii) a control box indicator light (925); (iii) an unlock button (940; 7; 450); (iv) a reset button (930; 13); and (v) a control box microprocessor operatively connected to each the second transmitter, the second receiver, the control box indicator light, the unlock button, and the reset button; and (c) a remote control having a remote control microprocessor disposed therein and a remote control transmitter operatively connected to the remote control microprocessor;

wherein:

the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated;

the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position;

the control box microprocessor is configured to receive a first reset input signal from the reset button when the reset button is pressed whereupon the control box microprocessor generates a first reset output command to the control box indicator light to cause the control box indicator light to become deactivated;

the remote control further comprising a remote lock mailbox button, a remote open mailbox button, and a remote reset button each operatively connected to the remote control microprocessor, wherein the remote control microprocessor is configured to: (a) receive a first remote lock button input signal from the remote lock mailbox button when the remote lock mailbox button is pressed, wherein when the remote control microprocessor receives the first remote lock button input signal the remote control microprocessor sends a first remote transmitter output command to the remote control transmitter to cause the remote control transmitter to send a first remote transmitter signal to the first receiver in the mailbox housing, wherein when the first receiver receives the first remote transmitter signal, the first receiver sends a first remote lock input signal to the mailbox microprocessor, wherein upon receipt of the first remote lock input signal, the mailbox microprocessor generates a first lock output command to the lock system so as to lock the lock system; (b) receive a first remote open button input signal from the remote open mailbox button when the remote open mailbox button is pressed, wherein when the remote control microprocessor receives the first remote open button input signal the remote control microprocessor sends a second remote transmitter output command to the remote control transmitter to cause the remote control transmitter to send a second remote transmitter signal to the first receiver in the mailbox housing, wherein when the first receiver receives the second remote transmitter signal, the first receiver sends a second unlock input signal to the mailbox microprocessor, wherein upon receipt of the second unlock input signal, the mailbox microprocessor generates a first unlock output command to the lock system so as to unlock the lock system; and (c) receive a first remote rest button input signal from the remote reset button when the remote reset button is pressed, wherein when the remote control microprocessor receives the first remote reset button input signal the remote control microprocessor sends a third remote transmitter output command to the remote control transmitter to cause the remote control transmitter to send a third remote transmitter signal to the second receiver in the control box, wherein when the second receiver receives the third remote transmitter signal, the second receiver sends a fifth receiver input signal to the control box microprocessor, wherein upon receipt of the fifth receiver input signal, the control box microprocessor generates a fifth reset output command to the alarm system so as to reset the alarm system.

14. The system of claim 1 further comprising a control box lock button disposed on the control box and operatively connected to the control box microprocessor, the control box microprocessor is configured to receive a first control box lock input signal from the control box lock button when the control box lock button is pressed, wherein upon receipt of the first control box lock input signal, the control box microprocessor generates a fifth transmitter output command to the second transmitter to cause the second transmitter to send a fifth transmitter signal to the first receiver in the mailbox housing, wherein when the first receiver receives the fifth transmitter signal, the first receiver send a first control box lock input signal to the mailbox microprocessor whereupon the mailbox microprocessor generates the first lock output command to the lock system to lock the lock system.

15. The system of claim 2, wherein the control box further comprises a secondary light component operatively connected to the control box microprocessor, the secondary light component is configured to be illuminated when the control box is plugged in.

16. The system of claim 15, wherein the secondary light component is configured to flash or blink when the alarm system is activated.

17. The system of claim 1 further comprising one or more solar panels operatively connected to the mailbox microprocessor, the lock system, the first receiver, or the second receiver, wherein the solar panels function to provide power.

* * * * *